United States Patent [19]

Komamura et al.

[11] Patent Number: 4,631,251

[45] Date of Patent: Dec. 23, 1986

[54] HEAT-DEVELOPABLE COLOR PHOTO-SENSITIVE MATERIAL WITH POLYMERIC COUPLER

[75] Inventors: Tawara Komamura, Hachioji; Shunji Suginaka, Tokyo; Kimie Tachibana, Hino, all of Japan

[73] Assignee: Konishiroku Photo Industry Co., Ltd., Tokyo, Japan

[21] Appl. No.: 771,000

[22] Filed: Aug. 30, 1985

[30] Foreign Application Priority Data

Aug. 31, 1984 [JP] Japan ..... 59-182506

[51] Int. Cl.[4] ..... G03C 1/40; G03C 5/54

[52] U.S. Cl. ..... 430/548; 430/203; 430/226; 430/351

[58] Field of Search ..... 430/203, 226, 351, 548, 430/617, 619

[56] References Cited

U.S. PATENT DOCUMENTS

| | | | |
|---|---|---|---|
| 4,455,363 | 6/1984 | Naito et al. | 430/226 |
| 4,483,914 | 11/1984 | Naito et al. | 430/226 |
| 4,500,624 | 2/1985 | Aono et al. | 430/203 |
| 4,522,916 | 6/1985 | Hirano et al. | 430/548 |

*Primary Examiner*—Richard L. Schilling

*Attorney, Agent, or Firm*—Finnegan, Henderson, Farabow, Garrett & Dunner

[57] ABSTRACT

In a heat-developable color photo-sensitive material comprising a support bearing thereon a photographic component layer containing at least a photo-sensitive silver halide, a reducing agent, a binder and a dye-providing material; said heat-developable photo-sensitive material characterized in that at least one of said dye-providing materials is a polymer having a repetition unit being derived from a monomer Formula [I] below:

Formula [I]

wherein , Q represents an ethylene unsaturated group or a group having an ethylene unsaturated group; Z represents a group of atoms required for forming a nitrogen-containing heterocyclic residual group in which a polymerizable ethylene unsaturated bonding may also be incorporated into the heterocyclic ring, together with a nitrogen atom; $R_1$ represents an alkyl, aryl, alkylamino, anilino, acylamino or ureido group; Ar represents an aryl group or a heterocyclic residual group; and n is an integer of zero or one.

13 Claims, No Drawings

HEAT-DEVELOPABLE COLOR PHOTO-SENSITIVE MATERIAL WITH POLYMERIC COUPLER

BACKGROUND OF THE INVENTION

This invention relates to a heat-developable color photo-sensitive material in which a color-image is produced by transferring a dye formed in a heat-development process, and more particularly to a heat-developable color photo-sensitive material containing a novel dye-providing material capable of producing a diffusion type dye through a heat-development process.

Photographic method using a photo-sensitive silver halide has so far been known and that is superior to the other photographic methods in photo-sensitivity, gradation and image preservability and has most popularly been put into practice.

In this method, however, a wet-process has been applied to such a processing step as a developing, fixing or washing step. There have accordingly been many problems such as that it cannot help taking a lot of time and trouble and concerning about the influence of processing chemicals the human body or about the chemical pollution of a processing room and an operator, and further taking care of industrial waste pollution. It has therefore been demanded to develop a photo-sensitive material capable of using a photo-sensitive material therein and being applied with a dry-process.

There have been made a number of proposals of the above-mentioned dry-processing photographic methods. Among them, a heat-developable photo-sensitive material capable of being developed by a heat-treatment has now become the object of public attention.

Concerning these heat-developable photo-sensitive materials the photo-sensitive materials each comprising an organic silver salt, a silver halide and a reducing agent are disclosed in, for example, Japanese Patent Examined Publication Nos. 4921/1968 and 4924/1968.

There have been the attempts to obtain color-images in a variety of methods through the improvements on the above-mentioned photo-sensitive materials.

For example, the heat-developable color photo-sensitive materials for forming color images through the reaction of couplers with the oxidants of an aromatic primary amine developing agent are disclosed in U.S. Pat. Nos. 3,531,286, 3,761,270, 3,764,328 and the like.

In Research Disclosure, Nos. 15108 and 15127, the heat-developable color photo-sensitive materials are disclosed to produce color images through the reaction of couplers with the oxidants of developing agent of a sulfonamidophenol derivative or a sulfonamidoaniline derivative. In these processes, however, a reduced silver image and a color image are produced simultaneously on an exposed area after heat-developed, and the color image is made turbid, that is a problem. As for the methods of solving such a problem, there are some methods such as that a silver image is removed in a liquid process or that dyes only are transferred to other layer such as an image receiving sheet having an image receiving layer, however, there is also a problem that it is not so easy to transfer the dyes only to the image receiving sheet with the discrimination thereof from the substances remaining unreacted.

Further, in Research Disclosure, No. 16966, there discloses a heat-developable color photo-sensitive material in which an organic imino salt having dyes as the composition thereof is used so as to split off the imino group in an exposed area through a heat-development, and a color image is produced on an image receiving layer in the form of a sheet of transfer-paper by making use of a solvent. In this process, however, there is a problem that it is impossible to obtain a sharp and clear color image because it is difficult to inhibit the splitting-off of the dyes in an area out of light.

Still further, in Japanese Patent O.P.I. Publication Nos. 105821/1977, 105822/1977 and 50328/1981; U.S. Pat. No. 4,235,957; Research Disclosure, Nos. 14448, 15227 and 18137; and the like, there are disclosed the respective heat-developable color photo-sensitive materials in which a positive color image can be produced in a heat-sensitive silver dye bleach process. Wherein, there are problems that an extra processing step and photographic component material are required, such as that some sheets containing an activator for accelerating the bleach of dyes are superposed together and are then heated, and that the obtained color image is gradually reduced and bleached by a co-existing free silver or the like during a long-term preservation.

In addition to the above disclosures, there are U.S. Pat. Nos. 3,180,732, 3,985,565, and 4,022,617; and Research Disclosure No. 12533 each disclosing the heat-developing color photo-sensitive materials utilizing a leuco dyes to produce a color image. In this process, however, there is a problem that the photo-sensitive materials are gradually colored during the preservation, because it is difficult to incorporate the leuco dyes stably into the photo-sensitive materials.

In addition, Japanese Patent O.P.I. Publication No. 179840/1982 (U.S. Pat. No. 4,463,079) discloses a heat-developable color photo-sensitive material in which a color image pattern is formed by making use of a reducible dye-providing material capable of releasing both a dye-releasing assistant and a diffusible dye. In this method, however, it is inevitable to use the dye-releasing assistant, and this dye-releasing assistant is the so-called base or a basic precursor. There are the problems in the technique using such a base or a basic precursor, namely, fog is increased and a maximum density is lowered due to the existence of the base in the case of a heat-developable photo-sensitive material using an organic silver salt oxidizing agent.

Further, Japanese Patent O.P.I. Publication Nos. 186744/1982 (U.S. Pat. No. 4,474,867), and 123533/1983 discloses the heat-developable color photo-sensitive materials in which a color transfer image pattern is obtained by releasing or producing a diffusible dye through a heat-development process. However, the exemplified compounds of the dye-providing materials disclosed therein have such a defect that it is hard to say that the migration of the compounds between the layers is completely prohibited during the multiple coating or heat-developing process, so that a color turbidity is apt to cause.

As disclosed in Japanese Patent O.P.I. Publication No. 149047/1983 (U.S. Pat. No. 4,455,363) as well as in Japanese Patent Application No. 109293/1983 which was applied by the present inventors, there are the methods with the purpose of compensating the above-mentioned defect, in which a polymer is used to serve as a dye-providing material. Even the exemplified compounds described therein have the detects that, though the migration of dye-providing material is successfully prohibited, the efficiency of producing diffusible dye is substantially low and a maximum density (Dmax) of a transfer image pattern or the fog (Dmin) thereof is serious.

It is an object of the invention to solve the problems inhering in the above-mentioned dye-providing materials, that it to say, it is an object of the invention to provide a heat-developable color photo-sensitive material containing a novel dye-providing material.

Another object of the invention is to provide a heat-developable color photo-sensitive material capable of obtaining a color image pattern which is less in color turbidity and sharp in reproductivity.

A further object of the invention is to provide a dye-providing polymer which is excellent in efficiency of producing a diffusible dye.

A still further object of the invention is to provide a magenta-dye-providing polymer capable of obtaining a transfer image pattern which is high in density and less in fogginess.

SUMMARY OF THE INVENTION

The present inventors have devoted themselves in their studies with the purpose of achieving the above-mentioned objects, and consequently, the inventors have found that the objects of the invention can be achieved by a heat-developable color photo-sensitive material comprising a support bearing thereon a photographic component layer containing at least a photosensitive silver halide, a reducing agent, a binder and a dye-providing material, among which at least one of the dye-providing material is a polymer having a repetition unit being derived from a monomer represented by the Formula [I] below:

Formula [I]

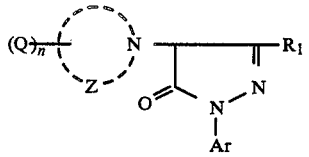

wherein, Q represents an ethylene unsaturated group or a group having an ethylene unsaturated group; Z represents a group of atoms required for forming a nitrogen-containing heterocyclic residual group in which a polymerizable ethylene unsaturated bonding may also be incorporated into the heterocyclic ring, together with a nitrogen atom; $R_1$ represents an alkyl, aryl, alkylamino, anilino, acylamino or ureido group; Ar represents an aryl group or a heterocyclic residual group; and n is an integer of zero or one.

DETAILED DESCRIPTION OF THE INVENTION

In the above-given Formula [I], $R_1$ represents an alkyl, aryl, alkylamino, anilino, acylamino or ureido group. These alkyl, aryl, alkylamino, anilino, acylamino and ureido groups are allowed to have the respective substituents. Such substituents include, for example, a halogen atom such as fluorine, chlorine and bromine atoms and the like; a straight- or branched-chained alkyl group such as methyl, ethyl and t-butyl groups; an alkoxy group such as methoxy and ethoxy groups; an acylamino group such as acetamide and benzamide groups; an aryloxy group such as phenyloxy group; an alkoxycarbonyl group such as methoxycarbonyl group; a nitro group; a hydroxy group; and the like. The groups each represented by $R_1$ are allowed to have two or more of these substituents. In the case of two or more substituents, they are allowed to be the same or different from each other.

In the above-given formula [I], Ar represents an aryl group or a heterocyclic residual group. The aryl groups represented by Ar include, for example, a phenyl group and the like. The heterocyclic residual groups include, for example, a pyridyl, imidazolyl and benzothiazolyl groups and the like. The aryl group and the heterocyclic residual group represented by Ar are allowed to have the respective substituents. Such substituents include, for example, a halogen atom such as fluorine, chlorine and bromine atom; an alkyl group being allowed to have substituent such as methyl, ethyl and trifluoromethyl groups; an alkoxy group such as methoxy and ethoxy groups; an aryloxy group such as phenyloxy group; an acylamino group such as acetylamino group; a carbamoyl group including a substituted carbamoyl group, such as methyl, ethyl and phenyl groups as the substituents thereof; an alkylsulfonyl group such as methylsulfonyl group; an arylsulfonyl group such as phenylsulfonyl group; an alkylsulfonamido group such as methanesulfonamide group; an arylsulfonamide group such as phenylsulfonamide group; a sulfamoyl group including a substituted sulfamoyl group and the substituents thereof include, for example, methyl, ethyl and phenyl groups; an alkylthio group such as methylthio group; an arylthio group such as phenylthio group; a cyano group; nitro group; hydroxy group; and the like. These substituents are allowed to be two or more, and in the case of two or more of them, they are allowed to be the same or different from each other.

In the above-given formula [I], Z represents a group of atoms required for forming a nitrogen-containing heterocyclic residual group in which a polymerizable ethylene unsaturated bond may be incorporated into the ring thereof, together with a nitrogen atom. This nitrogen-containing heterocyclic residual group is also allowed to form a condensation ring with the other carbon ring such as benzene ring or heterocyclic residual group. In particular, in the above-given Formula [I], when n is equal to zero, it is allowed to have an ethylene unsaturated bond in the ring of the heterocyclic residual group. As for the above-mentioned nitrogen-containing heterocyclic residual group, they include, for example, 1,2,3-benzotriazole-2-yl, 1,3-dioxoisoindoline-2-yl, piperazine-1-yl, pyrazole-1-yl, piperidine-1-yl, 1H-indazole-1-yl, indole-1-yl, 3-pyrroline-1-yl, and the like. As for the nitrogen-containing heterocyclic residual group, those having a carbonyl group in the adjacent position of the nitrogen atom are particularly preferable.

In the above-given Formula [I], the nitrogen-containing heterocyclic residual groups together with nitrogen atoms represented by Z are allowed to have substituents. Such substituents include, for example, an alkyl group such as methyl group and ethyl group, an aryl group such as phenyl group, an alkoxy group such as methoxy group and ethoxy group, and the like.

In the above-given Formula [I], Q represents an ethylene unsaturated group or a group having an ethylene unsaturated group, and they are preferably represented by the following Formula [II]:

Formula [II]

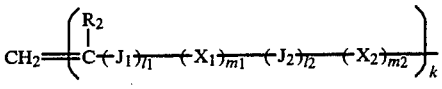

wherein, $R_2$ represents hydrogen atom, a carboxy group or an alkyl group such as methyl or ethyl group, and this alkyl group is allowed to have a substituent which includes, for example, a halogen atom such as fluorine atom, chlorine atom and the like, and a carboxy group. The carboxy group and the carboxy group as the substituent each represented by $R_2$ are allowed to form a salt; $J_1$ and $J_2$ represent a divalent bonded group, respectively, which includes, for example, —NHCO—, —CONH—, —COO—, —OCO—, —SCO—, —COS—, —O—, —S—, —SO—, —$SO_2$— and the like; $X_1$ and $X_2$ represent a divalent hydrocarbon group which includes, for example, an alkylene, arylene, aralkylene, alkylenearylene or arylenealkylene group, and the alkylene group includes, for example, methylene, ethylene and propylene group and the like; the arylene group includes, for example, phenylene group and the like; the aralkylene group includes, for example, phenylmethylene group and the like; the alkylenearylene group includes, for example, methylenephenylene group and the like; and the arylenealkylene group includes, for example, phenylenemethylene group and the like; and k, $l_1$, $m_1$, $l_2$, $m_2$, each are an integer of zero or one, respectively.

The polymers having a repetition unit being derived from a monomer represented by the above-given Formula [I] will form a diffusible dye through a coupling reaction with the oxidation product of the reducing agent. It is preferable for improving the diffusibility of the dye to be produced that $R_1$ and Ar are so selected as to make the molecular weight of the coupler residual group

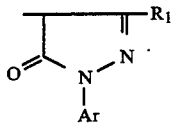

no more than 700, and more preferably not more than 500.

Typical examples of the monomer compounds represented by the above-given Formula [I] of the invention are given below, and it is, however, to be understood that the invention shall not be limited thereto.

Exemplified monomer

M-1

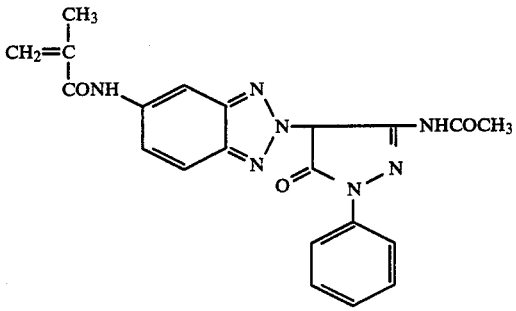

M-2

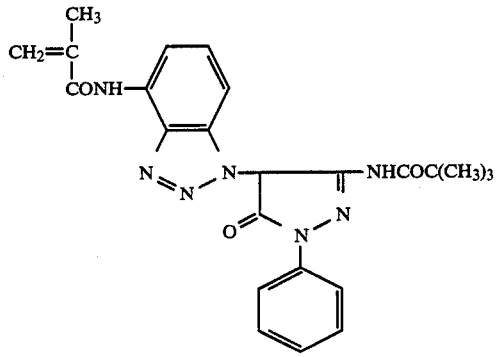

-continued
Exemplified monomer
M-3
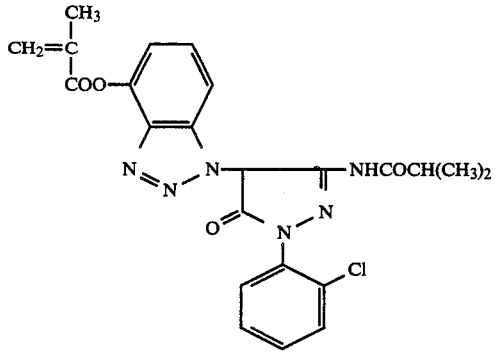
M-4
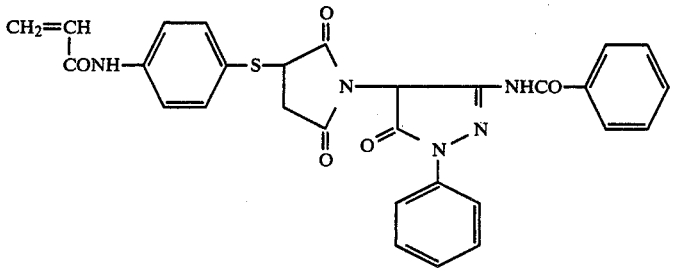
M-5
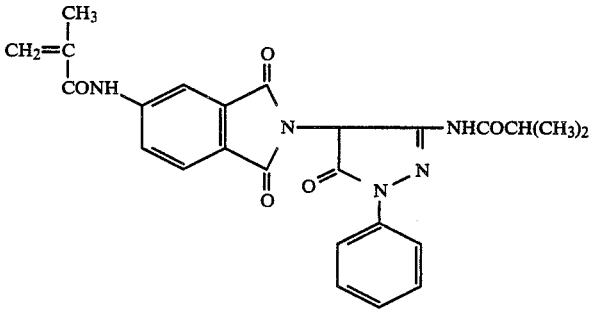
M-6
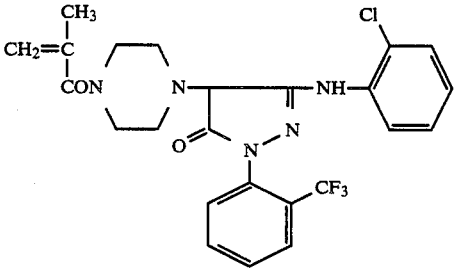
M-7
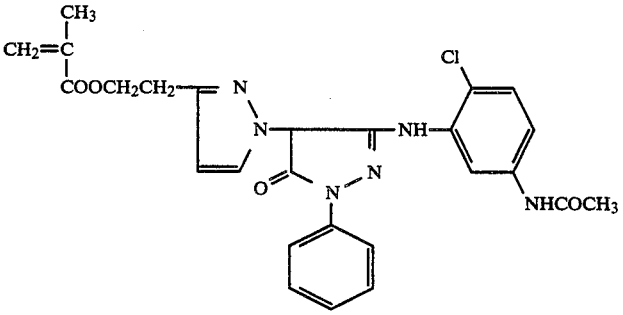

-continued
Exemplified monomer
M-8
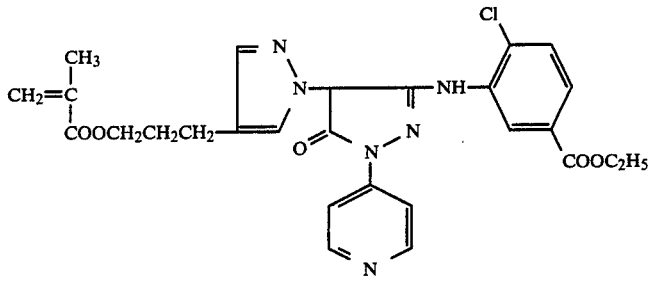
M-9
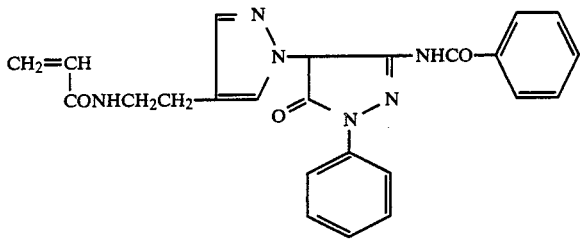
M-10
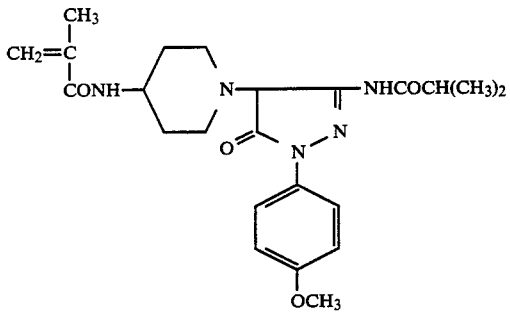
M-11
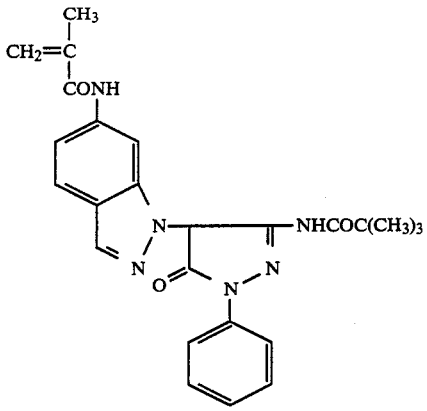
M-12
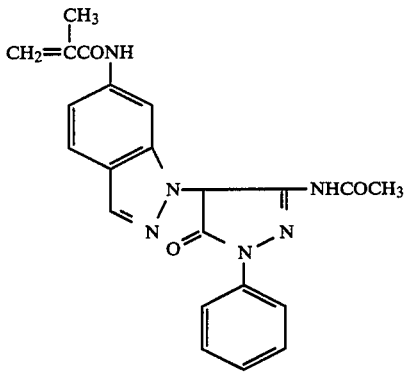

-continued
Exemplified monomer
M-13
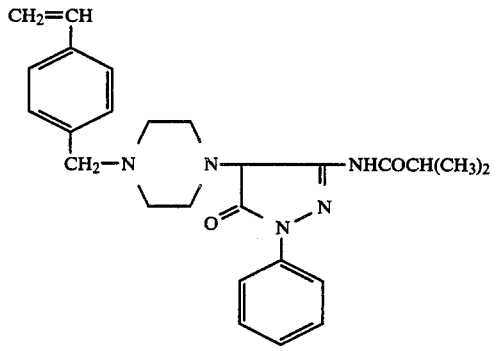
M-14
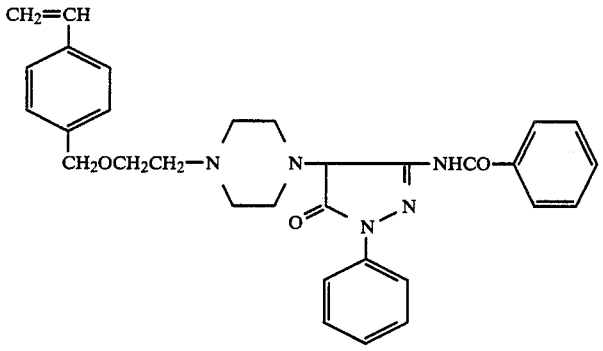
M-15
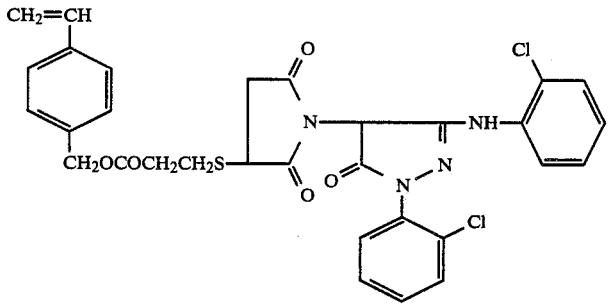
M-16
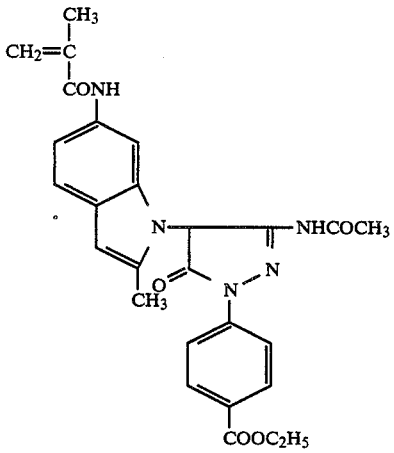

-continued
Exemplified monomer
M-17
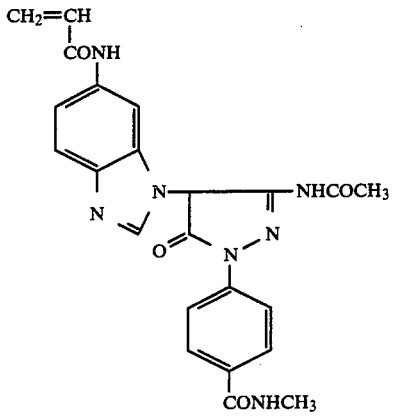
M-18
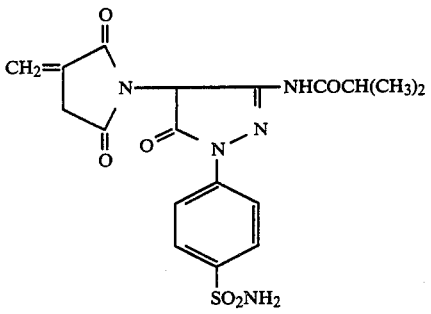
M-19
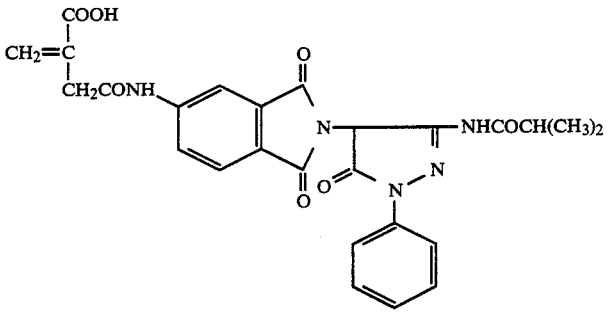
M-20
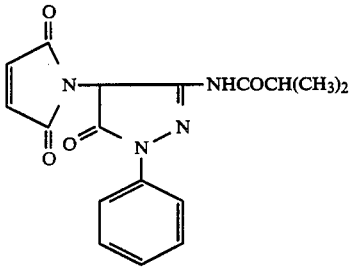
M-21
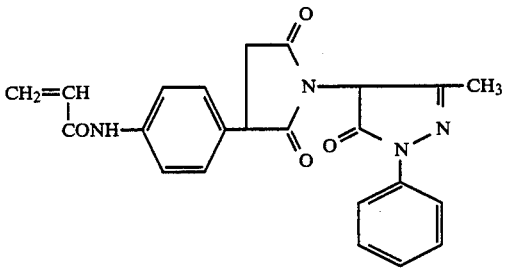

-continued
Exemplified monomer
M-22
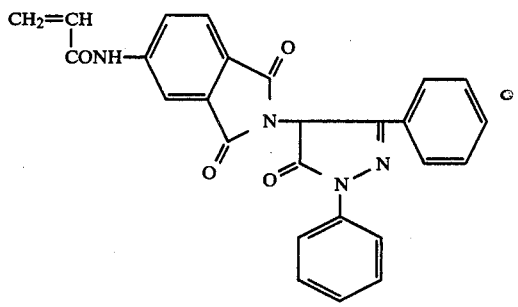
M-23
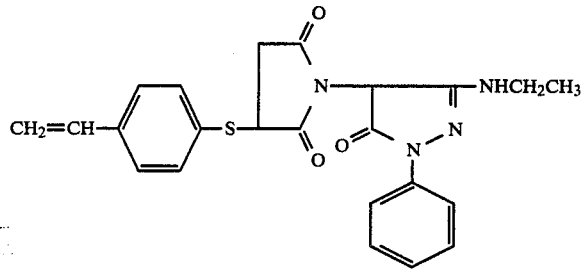
M-24
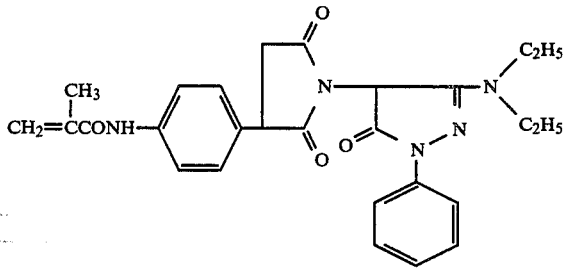
M-25
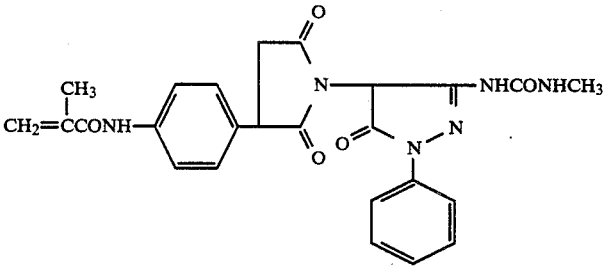
M-26
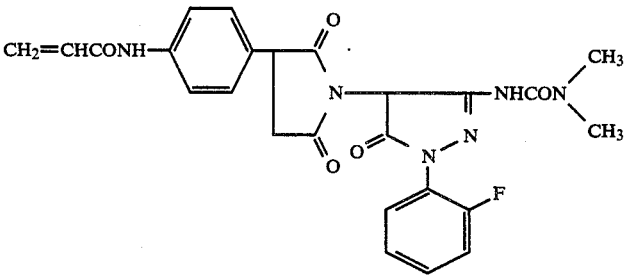

-continued

Exemplified monomer

M-27

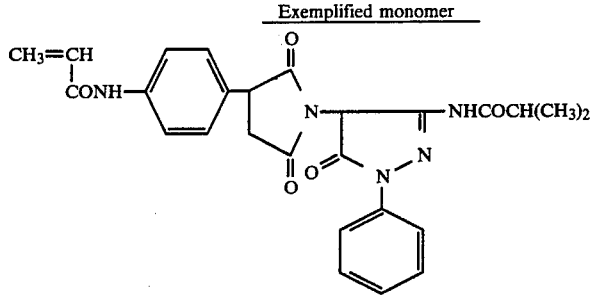

Typical synthesis examples of the monomers represented by the aforegiven Formula [I] of the invention are given below:

SYNTHESIS EXAMPLE 1

(SYnthesis of Exemplified Monomer M-5)

<Synthesis of intermediate>

Synthesis of 1-phenyl-3-isobutylylamino-4-nitroso-5-pyrazolone (hereinafter called Intermediate A):

Dissolution of 24.5 g of 1-phenyl-3-isobutylylamino-5-pyrazolone was made in 250 ml of acetic acid and the resulting solution was added with 10 mg of sodium nitrite while stirring at room temperature. After stirring for one hour, the resulting reactant mixture was poured into ice-water and the deposited solids were gathered. Thus, 21.9 g of the warm-orange colored solid (whose melting point was from 199° C. to 201° C.) were obtained.

Synthesis of 1-phenyl-3-isobutylylamino-4-(3-aminophthalimide)-5-pyrazolone (hereinafter called Intermediate B):

Dissolution of 5.5 g of Intermediate A was made in 100 ml of acetic acid and the resulting solution was added gradually with 6.6 g of zinc in the state of nitrogen-air flow at room temperature and then stirred for 30 minutes, and the resulting reactant liquid was filtrated. The filtrate was added with 4.3 g of anhydrous 3-nitrophthalic acid and 10 ml of anhydrous acetic acid and was stirred under nitrogen-air flow for two hours, and then the resulting reactant liquid was filtrated. The filtrate was poured into water and was neutralized with sodium carbonate, and then the resulting deposited solids were gathered. The solids were added in 200 g of ethanol so as to be hydrogen-reduced with palladium-carbon as a catalyst. The resulting reactant liquid was filtrated, and the filtrate was condensed. Thus, 4.6 g of the objective, i.e., Intermediate B, were obtained.

<Synthesis of Exemplified Monomer M-5>

Mixture of 3.8 g of the above-mentioned Intermediate B and 6 ml of pyridine was made in 30 ml of acetonitrile, and into which 1.05 g of methacrylic acid chloride (which was dissolved in 10 ml of acetonitrile) were dropped at a temperature of not higher than 10° C. After stirring for one hour at room temperature, the resulting reactant liquid was poured into water and was then neutralized with dilute hydrochloric acid. The resulting deposited solids were filtrated, and the filtrated solids were dissolved in 50 cc of methanol and 10 cc of 30% aqueous ammonia were added. After stirring for one hour, the resulting solution was poured into 200 cc of water and was then neutralized with dilute hydrochloric acid. The resulting deposited solids were filtrated, and thus, 4.0 g of the objective, i.e., Intermediate B, were obtained.

The structures of the above-mentioned Intermediates, A and B, and Exemplified Monomer M-5 were confirmed by NMR, IR and mass-spectrum.

The polymers each having a repetition unit, which are derived from the monomeric compounds of the invention represented by the Formula [I], may be the so-called homopolymers each having a repetition unit, which comprise only one kind of the monomers represented by the Formula [I], or they may be the copolymers each comprising a combination of not less than two kinds of the monomers having the Formula [I], or they may further be copolymers each comprising one or more kinds of other monomers (hereinafter called a comonomer) each having copolymerizable ethylene unsaturated group.

As for the comonomers each having the above-mentioned ethylene unsaturated group, which are capable of forming a copolymer with the monomers of the invention having the Formula [I], there may be an ester acrylate, an ester methacrylate, a vinyl ester, an olefin, a styrene, an ester crotonate, a diester itaconate, a diester maleate, a diester fumarate, an acrylamide, an allyl compound, a vinyl ether, a vinyl ketone, a heterocyclic vinyl compound, a glycidyl ester, an unsaturated nitrile, a polyfunctional monomer, a variety of unsaturated acids and the like.

These comonomers are more concretely exemplified as follows; the acrylic acid esters include, for example, methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethyl hexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxy acrylate, 2-butoxyethyl acrylate, 2-(2-methoxyethoxy)ethyl acrylate, 2-(2-butoxyethoxy)ethyl acrylate, ω-methoxypolyethyleneglycol acrylate, (added mol number n=9), 1-bromo-2-methoxyethoxy acrylate, 1,1-dichloro-2-ethoxyethyl acrylate.

The methacrylic acid esters include, for example, methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethyleneglycol monomethacrylate, dipropyleneglycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxymethoxy)ethyl methacrylate, 2-(2-butoxyethoxy)ethyl methacrylate, ω-methoxypolyethyleneglycol methacrylate (added mol number n=6), allyl methacrylate, methacrylic acid dimethylaminoethyl methyl chrolide salt.

The vinyl esters include, for example, vinyl acetate, vinyl propionate, vinyl butylate, vinyl isobutylate, vinyl caproate, vinyl chloroacetate, vinyl methoxyacetate, vinyl phenylacetate, vinyl benzoate and vinyl salicylate.

The olefins include, for example, dicyclopentadiene, ethylene, propylene, 1-butene, 1-pentene, vinyl chloride, vinylidene chrolide, isoprene, chloroprene, butadiene and 2,3-dimethylbutadiene.

The styrenes include, for example, styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene and methyl vinylbenzoate.

The crotonic acid esters include, for example, butyl crotonate, hexyl crotonate and the like.

The itaconic acid diesters include, for example, dimethyl itaconate, diethyl itaconate, dibutyl itaconate and the like.

The maleic acid diesters include, for example, diethyl maleate, dimethyl maleate, dibutyl maleate and the like.

The fumaric acid diesters include, for example, diethyl fumarate, dimethyl fumarate, dibutyl fumarate and the like.

The examples of the other comonomers may be given as follows.

An acrylamide such as acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide and N-(2-acetoacetoxyethyl)acrylamide;

A methacrylamide such as methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenyl methacrylamide dimethylmethacrylamide, β-cyanoethylmethacrylamide and N-(2-acetoacetoxyethyl)methacrylamide.

An allyl compound, such as allyl acetate, allyl caproate, allyl laurate and allyl benzoate;

A vinylether, such as methylvinylether, butylvinylether, hexylvinylether, methoxyethylvinylether and dimethylaminoethylvinylether;

A vinylketone, such as methylvinylketone, phenylvinylketone and methoxyethylvinylketone;

A vinylheterocyclic compound, such as vinylpyridine, N-vinylimidazole, N-vinyloxazolidone, N-vinyltriazole and N-vinylpyrolydone;

A glycidyl ester, such as glycidyl acrylate and glycidyl methacrylate;

An unsaturated nitrile such as acrylonitrile and methacrylonitrile;

A multi-functional monomer, such as divinylbenzene, methylenebisacrylamide and ethyleneglycol dimethacrylate.

Further, the monomer are given as acrylic acid, methacrylic acid, itaconic acid, maleic acid and a monoalkyl itaconate, such as monomethyl itaconate, monoethyl itaconate and monobutyl itaconate; a monoalkyl maleate such as monomethyl meleate, monoethyl maleate and monobutyl maleate; citraconic acid, stylenesulfonic acid, vinylbenzylsulfonic acid, vinylsulfonic acid, an acryloyloxyalkylsulfonic acid such as acryloyloxymethylsulfonic acid, acryloyloxyethylsulfonic acid, acryloyloxypropylsulfonic acid; a methacryloxyalkylsulfonic acid such as methacryloyloxymethylsulfonic acid, methacryloyloxyethylsulfonic acid and methacryloylpropylsulfonic acid; an acrylamidoalkylsulfonic acid such as 2-acrylamide-2-methylethanesulfonic acid, 2-acrylamide 2-methylpropanesulfonic acid and 2-acrylamido-2-methylbutanesulfonic acid; a methacrylamidoalkylsulfonic acid such as 2-methacrylamido-2-methylethanesulfonic acid, 2-methacrylamido-2-methylpropanesulfonic acid, 2-methacrylamido-2-methylbutanesulfonic acid, an acryloyloxyalkylphosphate such as acryloyloxyethylphosphate and 3-acryloyloxypropyl-2-phosphate; a methacryloyloxyalkylphosphate such as methacryloyloxyethylphosphate and 3-methacryloyloxypropyl-2-phosphate; and a 3-allyoxy-2-hydroxypropanesulfonic acid having two hydrophilic groups. These acids may also be such an alkaline metal as Na, K and the like, or an ammonium ion salt. As for the other comonomers, such a bridged monomer as described in U.S. Pat. Nos. 3,459,790, 3,438,708, 3,554,987, 4,215,195 and 4,247,673, and Japanese Patent O.P.I. Publication No. 205735/1982 and may be used. To be more concrete, they include, for example, N-(2-acetoacetoxyethyl)acrylamide, N-{2-(2-acetoacetoxyethoxy)ethyl}acrylamide, and the like.

In the case of forming a copolymer by making use of a monomer of the invention having the Formula [I] and the aforementioned comonomer, a preferable case thereof is that the contents of the repetition unit comprising a monomer having the Formula [I] are from 10 wt% to 90 wt% of the whole polymer, and more preferable case is that the contents thereof are 30 wt% to 70 wt% of the whole polymer.

In general, a polymer coupler is prepared in an emulsion-polymerization process or in a solution-polymerization process. The same processes may be applied to the dye-providing polymers of the invention having the repetition unit derived from the monomers of the invention having the Formula [I]. As for the emulsion-polymerization processes, those described in U.S. Pat. Nos. 4,080,211 and 3,370,952 may be applied, and as for the processes in which hydrophilic polymers are dispersed to serve as the latex into an aqueous solution of gelatin, those described in U.S. Pat. No. 3,451,820 may be applied.

These processes may also be applied to form a homopolymer or copolymer. In the latter case, the comonomers thereof may be liquid comonomers which may serve, in a normal state, as a solvent for a stationary monomer, when emulsification-polymerizing.

As for the emulsifying agents to be applicable to the emulsification-polymerization process, these include a surface active agent, a macromolecular protective colloid, and a copolymeric emulsifying agent. As for the surface active agents, there include, for example, an anionic active agent, a nonionic active agent, a cationic active agent, and an amphoteric active agent.

As for the anionic active agent, there are given as the examples, a soap, sodium dodecylbenzene sulfonate, sodium laurylsulfate, sodium dioctylsulfosuccinate, and a sulfuric acid salt of a nonionic active agent.

As for the nonionic active agents, there include, for example, a polyoxyethylene nonylphenyl ether, a polyoxyethylene stearic acid ester, a polyoxyethylene sorbitan monolaurylic acid ester, a polyoxyethylene-polyoxypropylene block copolymer, and the like. As for the cationic active agents, there include, for example, an alkylpyridium salt, tertiary amine and the like.

As for the amphoteric active agents there include, for example, a dimethyl alkyl betaine, an alkyl glycine and the like. As for the macromolecular protective colloids, there include, for example, a polyvinyl alcohol, hydroxyethyl cellulose and the like. They may be used independently to serve as an emulsifying agent and may also be used in combination with the other surface active agents. The various kinds and functions of these active agents are described in 'Belgische Chemische Industrie, 28, 16–20 (1963)'.

In order to disperse a lipophilic polymer synthesized in a solution polymerization process into an aqueous gelatin solution so that the polymer may be dispersed therein in the form of a latex, the lipophilic polymer is dissolved in an organic solvent first and the solution thereof is then dispersed latexwise in an aqueous gelatin solution, with the aid of a dispersing agent, by means of a supersonic colloid-mill or the like. The processes of dispersing a lipophilic polymer in the form of a latex into an aqueous gelatin solution are described in U.S. Pat. No. 3,451,820. As for the organic solvents for dissolving the lipophilic polymers, there include, for example, methyl acetate, ethyl acetate, propyl acetate, and the like, and an alcohol, a ketone, a halogenated hydrocarbon, an ether, and the like. These organic solvents may be used independently or in combination with two or more kinds of them.

In the case of preparing a dye-providing polymer relating to this invention, it is desired that the solvents to be used in a polymerization process are a monmomer and a well-qualified solvent for dye-providing polymers to be produced, and are relatively low in reactivity with a polymerization starting agent. To be more concrete, there include, for example, water, toluene, an alcohol (e.g., methanol, ethanol, iso-propanol, tert-butanol and the like), acetone, methyl ethyl ketone, tetrahydrofuran, dioxane, ethyl acetate, dimethyl formamide, dimethyl sulfoxide, acetonitrile, methylene chloride, and the like; and these solvents may be used independently or in a mixture of two or more kinds thereof.

The temperatures for a polymerization process are normally within the range of from 30° C. to 120° C., though it is necessary to take the kinds of the polymerization starting agents and the solvents into consideration.

As for the polymerization starting agents to be used in the emulsification-polymerization process or the solution-polymerization process for preparing a dye-providing polymer of this invention, there include the following ones:

As for a water-soluble polymerization starting agent, there include, for example, a persulfate such as potassium persulfate, ammonium persulfate, sodium persulfate and the like; a water-soluble azo compound such as 4,4'-azobis-4-sodium cyanovalerate, 2,2'-azobis(2-amidinopropane)chloride and the like; and hydrogen peroxide.

As for the lipophilic polymerization starting agents to be used in the solution-polymerization process, there include, for example, an azo compound such as azobisisobutylonitrile, 2,2'-azobis-(2,4-dimethylvaleronitrile), 2,2'-azobis-(4-methoxy-2,4-dimethylvaleronitrile), 1,1'-azobis(cyclohexanon-1-carbonitrile), 2,2'-azobisisocyanobutyric acid, dimethyl-2,2'-azobisisobutyrate, 1,1'-azobis(cyclohexanone-1-carbonitrile), 4,4'-azobis-4-cyanovaleric acid; a peroxide compound such as benzoyl peroxide, lauryl peroxide, chlorobenzyl peroxide, diisopropyl peroxycarbonate and di-t-butyl peroxide. The preferable ones among the above are benzoyl peroxide, chlorobenzyl peroxide, lauryl peroxide and the like.

These polymerization starting agents may be contained in the range of from 0.01 wt% to 10 wt% and more preferably from 0.1 wt% to 5 wt% to the aggregate quantity of monomers in the emulsification-polymerization process or in the solution-polymerization process.

Besides the above-mentioned processes, the other processes such as a suspension-polymerization process, a block-polymerization and the like may also be applied. In other words, in this invention, there contains every one of the dye-providing homopolymer of the monomers of the invention having the Formula [I], a copolymer comprising two or more of the monomers in combination, or a copolymer comprising the monomers and at least one kind of the other polymerizable comonomers as the copolymeric components. The synthesizing processes shall not limit the invention.

The following dye-providing polymers of the invention are given as the typical examples. It is, however, to be understood that the invention shall not be limited thereto.

Exemplified dye-providing polymers:

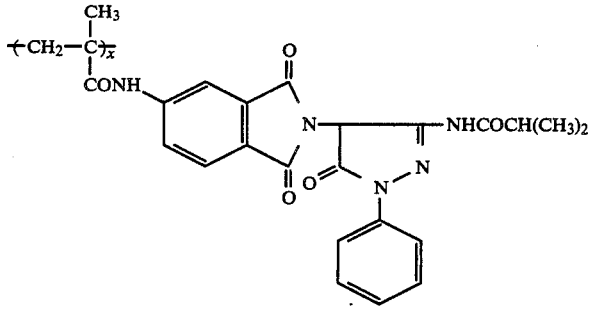

$\leftarrow CH_2-CH \rightarrow_y$ (COOC$_4$H$_9$)

(x = 50% by weight)
(y = 50% by weight)

PM-1

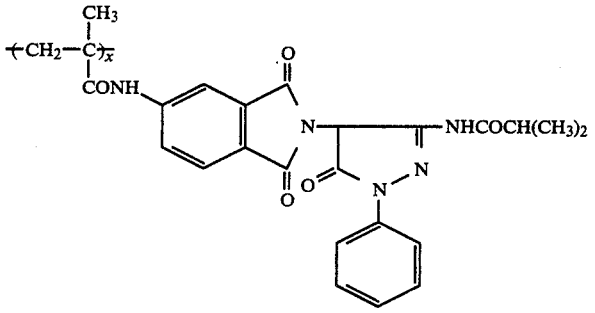

$\leftarrow CH_2-CH \rightarrow_y$ (COOC$_4$H$_9$)

(x = 30% by weight)
(y = 70% by weight)

PM-2

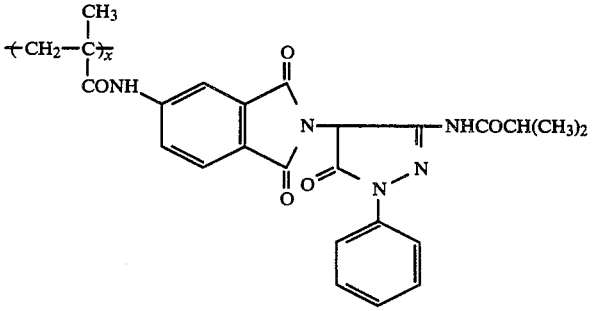

$\leftarrow CH_2-CH \rightarrow_y$ (COOCH$_3$)

(x = 40% by weight)
(y = 60% by weight)

PM-3

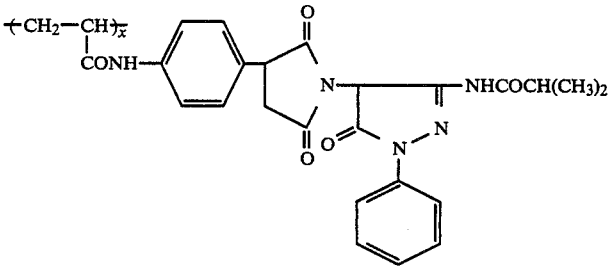

$\leftarrow CH_2-CH \rightarrow_y$ (COOC$_4$H$_9$)

(x = 40% by weight)
(y = 60% by weight)

PM-4

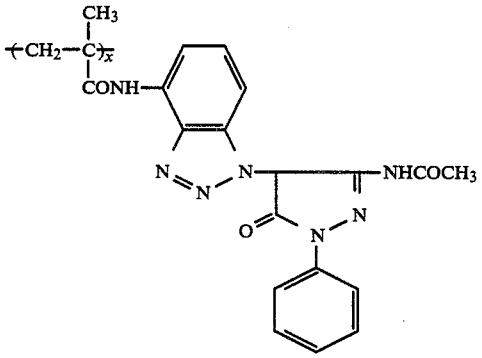

$\leftarrow CH_2-CH \rightarrow_y$ (COOC$_4$H$_9$)

(x = 50% by weight)
(y = 50% by weight)

PM-5

-continued
Exemplified dye-providing polymers:
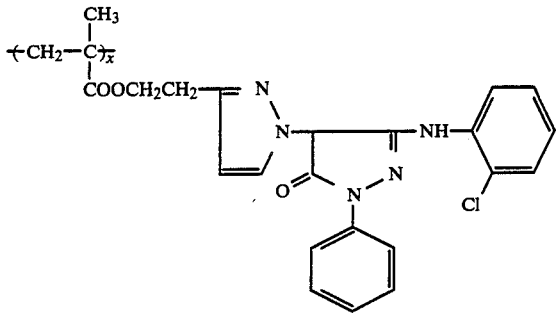
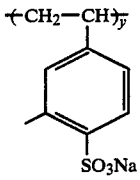
(x = 30% by weight)
(y = 70% by weight)
PM-6
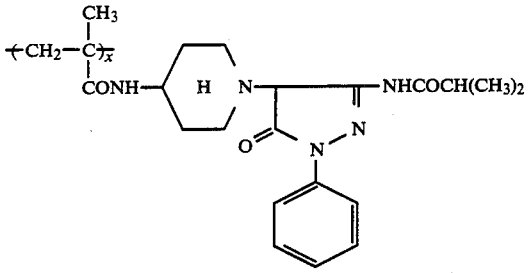
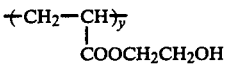
(x = 60% by weight)
(y = 40% by weight)
PM-7
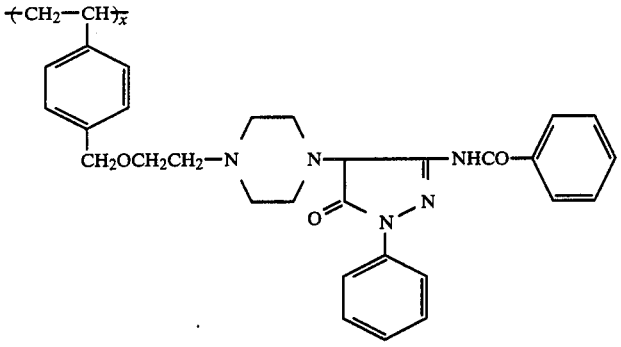
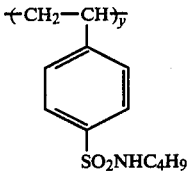
(x = 50% by weight)
(y = 50% by weight)
PM-8
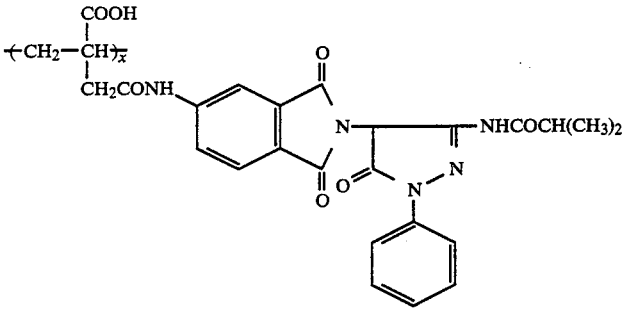
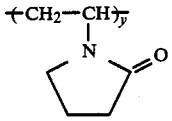
(x = 30% by weight)
(y = 70% by weight)
PM-9
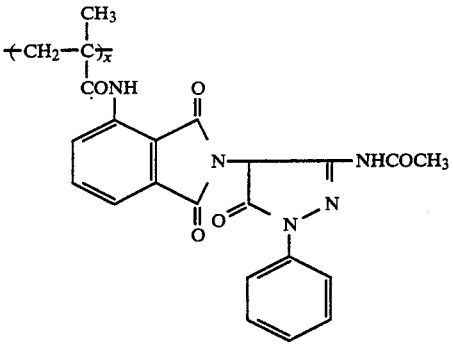
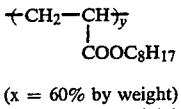
(x = 60% by weight)
(y = 40% by weight)
PM-10

-continued

Exemplified dye-providing polymers:

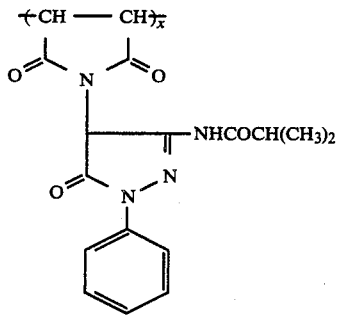

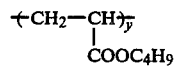

PM-11

(x = 30% by weight)
(y = 70% by weight)

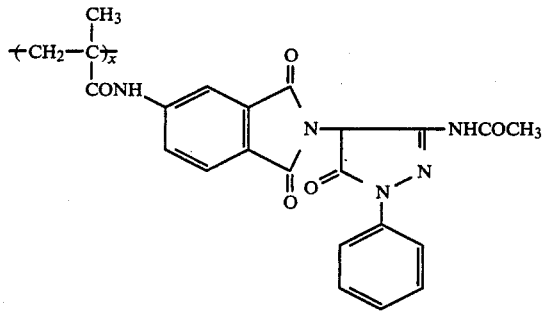

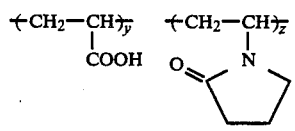

PM-12

(x = 40% by weight)
(y = 20% by weight)
(z = 40% by weight)

Synthesis examples of the above-mentioned dye-providing polymers of the invention will be given below:

SYNTHESIS EXAMPLE 2

Synthesis of Exemplified Dye-providing Polymer (PM-1)

A solution was prepared by adding 10 g of the exemplified monomer (M-5) and 10 g of butyl acrylate into 100 ml of dioxane and the resulting solution was heated up to 80°~82° C. under nitrogen air-flow. With keeping the temperature, 300 mg of 2,2-azobisisobutylonitrile were added and a reaction was made for four hours. After completing the reaction, the resulting reactant liquid was poured into one liter of water and the precipitates thereof were filtrated and dried. Thus, the objective polymer (PM-1) was obtained.

It is preferred that the molecular weight of a dye-providing polymer of the invention is within the range of from 1,500 to 100,000 in term of weight-average molecular weight ($\overline{Mw}$).

Any dye-providing polymer of the invention may be used independently or in combination. The amount thereof to be used is not limited but may be depended upon the kinds of the polymers, whether they are to be used independently or in combination with two or more of them or whether the photographic component layer of the photo-sensitive material of the invention is single-layered or multi-layered with two or more layers. For example, an amount to be used is from 0.005 g to 10 g and preferably from 0.1 g to 5.0 g per square-meter of a support.

Any arbitrary process may be applied to contain a dye-providing polymer of the invention in the photographic component layers of a heat-developable color photo-sensitive material. For example, the polymers of the invention may be contained in the component layer in such a manner that the polymers are dissolved in a low-boiling solvent such as methanol, ethanol, ethyl acetate or the like, or a high-boiling solvent such as dibutyl phthalate, dioctyl phthalate, tricresyl phosphate, or the like and the resulted solution is then dispersed by ultrasonic waves; that the polymers are dissolved in an aqueous alkali solution such as an aqueous solution of 10% sodium hydroxide or the like and the resulted solution is neutralized by a mineral acid such as chloric acid, nitric acid or the like; or that the polymers are dispersed together with an aqueous solution of a suitable polymer such as polyvinyl butyral, polyvinyl pyrrolidone, or the like, by making use of a ball-mill.

A heat-developable color photo-sensitive material of the invention contains a photo-sensitive silver halide as well as the above-mentioned dye-providing polymer of the invention.

The photo-sensitive silver halide to be used in the invention include, for example, silver chloride, silver bromide, silver iodide, silver chlorobromide, silver chloroiodide, silver iodobromide, silver chloroiodobromide, and the like. These photo-sensitive silver halide can be prepared in such an arbitrary process in the photographic technical field as a single-jet process, a double-jet process and the like. In the invention, the desired results are obtained with the use of photo-sensitive silver halide emulsions containing a photo-sensitive silver halide prepared in accordance with an ordinary preparation process of a silver halide gelatin emulsion.

Such photo-sensitive silver halide emulsions may also be chemically sensitized in an arbitary process used in the photographic technical field. As for such sensitizing processes, there are various processes including, for example, a gold sensitization, a sulphur sensitization, a gold-sulphur sensitization, a reduction sensitization, and the like.

The silver halide of the above-mentioned photo-sensitive emulsions may be either coarse grain or fine grain. The preferred grain sizes are from about 0.001 μm to about 1.5 μm in diameter and more preferably from about 0.01 μm to about 0.5 μm.

The photo-sensitive silver halide emulsions prepared as mentioned above can be most preferably applied to a heat-developable photo-sensitive layer that is a component layer of the photo-sensitive materials of this invention.

As for a process of preparing the other photo-sensitive silver halide, it is also possible, in this invention, to form a photo-sensitive silver halide in a portion of an organic silver salt by making a photo-sensitive silver salt forming component co-exist with an organic silver salt which will be described later. As for the photo-sensitive silver salt forming components to be used in this preparing process, an inorganic halide may be given as the example thereof, including, for example; a halide represented by MXn in which M represents hydrogen, $NH_4$ group or a metal atom, X represents Cl, Br or I and n is 1 when the M is hydrogen or $NH_4$ group, and when M is a metal atom, n is the valence thereof, and the metal atoms include those of lithium, sodium, potassium, rubidium, cecium, copper, gold, beryllium, magnesium, calcium, strontium, barium, zinc, cadmium, mercury, aluminum, indium, lanthanum, ruthenium, thalium, germanium, tin, lead, antimony, bismuth, chromium, molybdenum, wolfram, manganese, rhenium, iron, cobalt, nickel, rhodium, paradium, osmium, iridium, platinum, cerium; a halide-containing metal complex, such as $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhCl_6$, $(NH_4)_3RhBr_6$; an onium halide e.g., a quatarnary ammonium halide such as tetramethylammonium bromide, trimethylphenylammonium bromide, cetylethyldimethylammonium bromide, 3-methylthiazolium bromide and trimethylbenzylammonium bromide; a quartanary phosphonium halide, e.g., tetraethylphosphonium bromide; a tertiary sulfonium halide, e.g., benzylethylmethylsulfonium bromide and 1-ethylthiazolium bromide; a halogen substituted hydrocarbon, e.g., iodoform, bromeform, carbontetrachloride and 2-bromo-2-methylpropan; an N-halogen compound, e.g., N-chlorosuccinimide, N-bromosuccinimide, N-bromophthalimide, N-bromoacetamide, N-iodosuccinimide, N-bromophthaladinone, N-chlorophthaladinone, N-bromoacetanilide, N,N-dibromobenzenesulfonamide, N-bromo-N-methylbenzenesulphonamide and 1,3-dibromo-4,4-dimethylhydantoin; and the other halogen containing compounds, e.g., triphenylmethyl chloride, triphenylmethylbromide, 2-bromobutyric acid, and 2-bromoethanol.

These photo-sensitive silver halide and the photo-sensitive silver salt forming components may be used in combination in various processes. A preferable amount used thereof is from 0.002 mol to 10 mol, and a more preferable amount is from 0.02 mol to 2.0 mol per mol of a dye-providing material monomer unit.

The heat-developable color photo-sensitive materials of the invention may be qualified if at least one layer containing a photo-sensitive silver halide, reducing agent, binders and the dye-providing polymer of the invention is incorporated. It may also comprise each of blue-light-sensitive, green-light-sensitive and red-light-sensitive layers, namely, a multiple-layer comprising a heat-developable blue-light-sensitive layer, a heat-developable green-light-sensitive layer and a red-light-sensitive layer, and the same light-sensitive layer thereof may be divided into two or more layers such as a combination of a high sensitive layer and a low sensitive layer.

Each of the blue-light sensitive silver halide emulsion, green-light sensitive silver halide emulsion and red-light-sensitive silver halide emulsion to be used in the above-mentioned case may be prepared by adding various kinds of spectral sensitization dyes to the silver halide emulsions.

The spectral sensitization dyes which may typically be used in this invention include, for example, cyanine, merocyanine, a trinuclear or tetranuclear complex cyanine, holopolar cyanine, styryl, hemicyanine, oxonole and the like. Among the cyanine dyes, those each having a basic nucleus such as thiazoline, oxazoline, pyrroline, pyridine, oxazole, thiazole, selenazole, and imidazole are preferred to use. Such a nucleus may have an enamine group capable of producing an alkyl group, alkylene group, hydroxyalkyl group, sulfoalkyl group, carboxyalkyl group, aminoalkyl group, or a condensed carbocyclic or heterocyclic color ring. Also, it may be in the symmetric or unsymmetric form, and the methine chain or the polymethine chain thereof may have an alkyl group, a phenyl group, an enamine group and a heterocyclic substituent.

Besides the above-mentioned basic nuclei, the merocyanine dyes may also have, for example, such an acid nucleus as a thiohydantoin nucleus, a rhodanine nucleus, an oxazolidinedione nucleus, a barbituric acid a thiazolinethione nucleus, a malononitrile nucleus, and a pyrazolone nucleus. These acid nuclei may also be substituted by either of an alkyl, alkylene, phenyl, carboxyalkyl, sulfoalkyl, hydroxyalkyl, alkoxyalkyl or alkylamine group, or a heterocyclic ring nucleus. If required, these days may further be used in combination. It is still further possible to jointly use such a supersensitive additive incapable of absorbing any visible rays of light as an ascorbic acid derivative, an azaindene cadmium salt, an organic sulfonic acid and the like including, for example, those described in U.S. Pat. Nos. 2,933,390, and 2,937,089.

The amount of these dyes to be added is from $1\times10^{-4}$ mole to 1 mole per mol of a silver halide or a silver halide forming component, and more preferably, from $1\times10^{-4}$ to $1\times10^{-1}$ mole.

In the heat-developable color photo-sensitive materials of the invention, various kinds of organic silver salts may be used if required for increasing the sensitivity and improving the developability of the materials.

As for the organic silver salts to be used to the heat-developable color photo-sensitive materials of the invention, there may be given as the examples thereof the following; a aliphatic carboxylic acid silver salt such as silver laurate, silver myristate, silver palmitate, silver stearate, silver arachidonate, silver behenate, silver α-(1-phenyltetrazolethio) acetate and the like, an aromatic silver carboxylate such as silver benzoate, silver phthalate and the like, as described in Japanese Patent Examined Publication Nos. 4921/1968, 26582/1969, 18416/1970, 12700/1970, and 22185/1970, Japanese Patent O.P.I. Publication Nos. 52626/1974, 31728/1977, 137321/1977, 141222/1977, 36224/1978 and 37610/1978, and U.S. Pat. Nos. 3,330,633, 3,794,496, 4,105,451, 4,123,274 and 4,168,980, and the like; and silver salts of an imino group, e.g., those of benzotrizole, 5-nitrobenzotriazole, 5-chlorobenzotrizole, 5-methoxybenzotriazole, 4-sulfobenzotriazole, 4-hydroxybenzotriazole, 5-aminobenzotriazole, 5-carboxybenzotriazole, imidazole, benzimidazole, 6-nitrobenzimidazole, pyrazole, urazol, 1,2,4-triazole, 1H-tetrazole, 3-amino-5-benzylthio-1,2,4-triazole, saccharin, phthalazinone, phthalimide, and besides, those of 2-mercaptobenzoxazole, mercaptoxyadiazole, 2-mercaptobenzothiazole, 2-mercaptobenzimidazole, 3-mercapto-4-phenyl-1,2,4-triazole, 4-hydroxy-6-methyl-1,3,3a,7-tetrazaindene, and 5-methyl-7-hydroxy-1,2,3,4,6-pentazaindene, as described in Japanese Patent Examined Publication Nos. 26582/1969, 12700/1970, 18416/1970 and 22185/1970, Japanese Patent O.P.I. Publication Nos. 31728/1977 and 137321/1977, and Japanese Patent Application Nos. 1065/1982 and 1066/1982. Among the above-mentioned organic silver salts, silver salts of an imino group are preferred to use, especially silver salts of a benzotriazole derivative are preferred, and further, silver salts of a sulfobenzotriazole derivative are more preferred to use.

The organic silver salts to be used in the invention may be used independently or in combination with two or more kinds thereof. They may also be used in such a manner that they are isolated and are then dispersed in a binder by a suitable means, or in such a manner that a silver salt is prepared in a suitable binder and the resulting silver salt is used as it is without applying any isolation.

The amount of the above-mentioned organic silver salts to be used is preferably from 0.1 mol to 5 mol and more preferably from 0.3 mol to 3 mol, per mol of a dye-providing material monomer unit.

The reducing agents to be used in the heat-developable color photo-sensitive materials of the invention are those which are popularly used in the field of heat-developable color photo-sensitive materials. There may be given as the examples thereof the developing agents of p-phenylenediamine type, p-aminophenol type, phosphoramidophenol type, sulfonamidophenol type or hydrazone type color developing agent, described in, for example, U.S. Pat. Nos. 3,531,286, 3,761,270, and 3,764,328, Research Disclosure Nos. 12146, 15108 and 15127, and Japanese Patent O.P.I. Publication No. 27132/1981. There may also be used advantageously the color developing agent precursors and the like which are described in U.S. Pat. Nos. 3,342,599, and 3,719,492, and Japanese Patent O.P.I. Publication Nos. 135,628/1978 and 79035/1979.

The particularly preferable reducing agents may be given those represented by the following Formula [III] appeared in Japanese Patent O.P.I. Publication No. 146133/1981:

Formula [III]

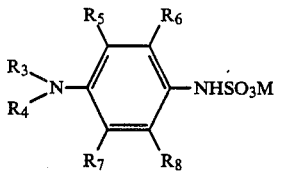

wherein, $R_3$ and $R_4$ each represent hydrogen or an alkyl group which is allowed to have a substituent and has one to 30 carbon atoms and preferably one to four carbon atoms, and the $R_3$ and $R_4$ may close a ring so as to form a heterocyclic ring; $R_5$, $R_6$, $R_7$ and $R_8$ each represent hydrogen, a halogen, a hydroxy group, an amino group, an alkoxy group, an acylamide group, a sulfonamide group, an alkylsulfonamide group, or an alkyl group which is allowed to have a substituent and has one to 30 carbon atoms, and preferably, one to four carbon atoms, and the $R_5$ and $R_3$, and the $R_7$ and $R_4$ each may close the ring so as to form a heterocyclic ring, respectively; and M represents an alkaline metal atom, an ammonium group, or a compound residual group containing a nitrogen-containing organic base or a quaternary nitrogen atom.

The nitrogen-containing organic base in the Formula [III] is an organic compound containing a nitrogen atom which is capable of producing an inorganic acid and a salt and displays a basicity. The particularly essential organic bases include, for example, an amine compound. Chain amine compounds include, for example, primary amine, secondary amine, and tertiary amine, and cyclic amine compounds include pyridine, quinoline, piperidine, imidazole and the like as the famous examples of the typical heterocyclic organic bases. Besides the above, such a compound as hydroxylamine, hydrazine, amidine and the like is also useful for a chain amine. As for the salts of nitrogen-containing organic bases, such as inorganic acid salt as a chloride, a sulfate, a nitrate or the like of the organic bases is preferably used.

On the other hand, as for the compounds each containing quaternary nitrogen in the formula above, there include, for example, a salt or hydroxide of a nitrogen compound having a quatrivalent covalent bond.

Next, some preferred examples of the reducing agents represented by Formula [III] above will be given below:

(R-1)

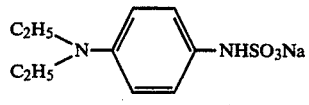

(R-2)

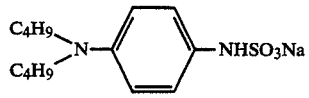

(R-3)

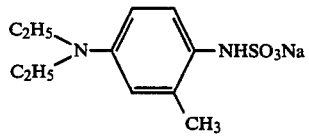

(R-4)

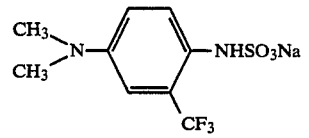

(R-5)

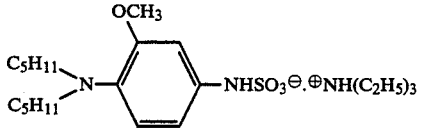

(R-6)

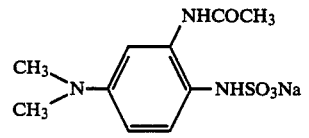

-continued (R-7)

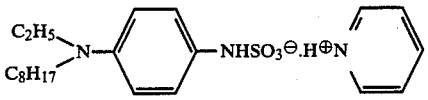

(R-8)

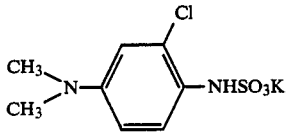

(R-9)

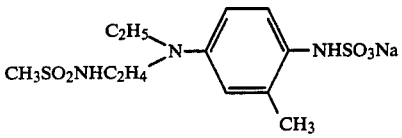

(R-10)

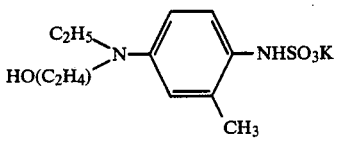

(R-11)

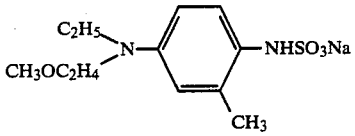

(R-12)

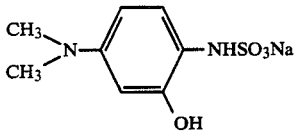

(R-13)

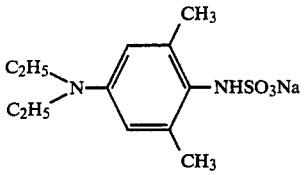

(R-14)

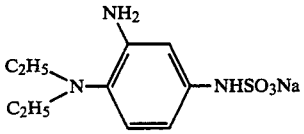

(R-15)

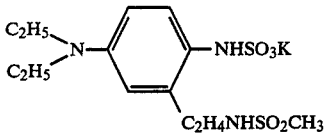

(R-16)

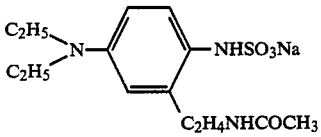

(R-17)

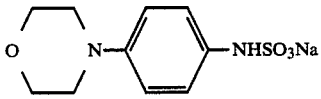

-continued (R-18)

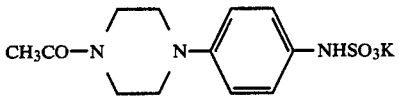

(R-19)

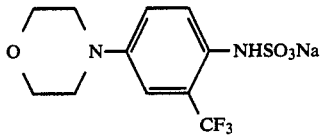

(R-20)

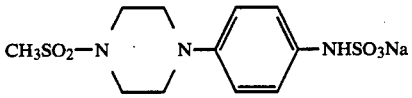

(R-21)

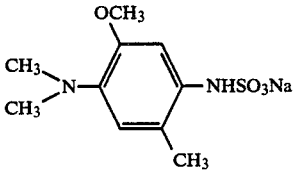

(R-22)

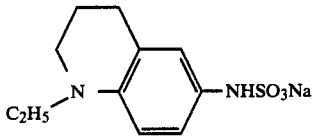

(R-23)

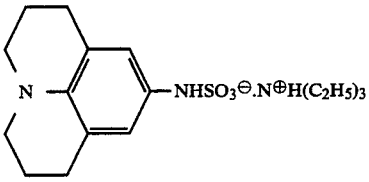

The reducing agents represented by Formula [III] may be synthesized in such a well-known process as described in, for example, Houben-Weyl, Methoden der Organischen Chemie, Band XI/2, pp. 645–703.

Besides the above, there may be used such a group of reducing agents as exemplified below:

A phenol (e.g., p-phenylphenol, p-methoxyphenol, 2,6-di-tert-butyl-p-cresol, N-methyl-p-aminophenol), a sulfonamidephenol {e.g., 4-benzenesulfonamidephenol, 2-benzensulfonamidephenol, 2,6-dichloro-4-benzenesulfonamidephenol, 2,6-dibromo-4-(p-toluenesulfonamide)phenol}, and a polyhydroxybenzene (e.g., hydroquinone, tert-butylhydroquinone, 2,6-dimethylhydroquinone, chlorohydroquinone, carboxyhydroquinone, catechol, 3-carboxycatechol), a naphthol (e.g., α-naphthol, β-naphthol, 4-aminonaphthol, 4-methoxynaphthol), a hydroxybinaphthyl and methylenebisnaphthol {e.g., 1,1′-dihydroxy-2,2′-binaphthyl, 6,6′-dibromo-2,2′-dihydroxy-1,1′-binaphthyl, 6,6′-dinitro-2,2′-dihydroxy-1,1′-binaphthyl, 4,4′-dimethoxy-1,1′-dihydroxy-2,2′-binaphthyl, bis(2-hydroxy-1-naphthyl)methan}, a methylenebisphenol {e.g., 1,1-bis(2-hydroxy-3,5-dimethylphenyl)-3,5,5-trimethylhexane, 1,1-bis(2-hydroxy-3-tert-butyl-5-methylphenyl)methane, 2,6-methylene-bis(2-hydroxy-3-tert-butyl-5-methylphenyl)-4-methylphenol, α-phenyl-α,α-bis(2-hydroxy-3,5-di-tert-butylphenyl)methane, α-phenyl-α,α-bis(2-hydroxy-3-tert-butyl-5-methylpheny)methan, 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethylphenyl)propane, 2,2-bis(4-hydroxy-3-methyl-5-tert-butylphenyl)propane; 2,2-bis(4-hydroxy-3,5-di-tert-butylphenyl)propane}, an ascorbic acid, a 3-pyrozolidone, a pyrazolone, a hydrazone, and a paraphenylenediamine and the derivatives thereof.

These reducing agents may be used independently or in combination with two or more thereof. The amount of the reducing agents used depends upon the kinds of photo-sensitive silver halide, the kinds of organic acid silver salts and the kinds of the other additives, and is normally from 0.05 mole to 10 mole per mole of a dye-providing material monomer unit, and more preferably, from 0.1 mole to 5 mole.

As for the binders to be used in the heat-developable color photo-sensitive materials of the invention, there may be used independently or in combination of two or more synthetic or natural high molecular substances such as polyvinyl butyral, polyvinyl acetate, ethyl cellulose, polymethyl methacrylate, cellulose acetate butylate, polyvinyl alcohol, polyvinyl pyrrolidone, gelatin and phthalic gelatin. In particular, it is preferable to use gelatin or the derivatives thereof in combination with such a hydrophilic polymer as polyvinyl pyrrolidone, polyvinyl alcohol or the like, and it is more preferable to use the under-mentioned binders described in Japanese Patent Application No. 104249/1983.

This binder contains gelatin and a vinyl pyrrolidone polymer. The vinyl pyrrolidone polymer may be a polyvinyl pyrrolidone which is a homopolymer of vinyl pyrrolidone or may be a copolymer, including a graft copolymer, of vinyl pyrrolidone and one or two of the other monomers capable of polymerizing with the vinyl pyrrolidone. These polymers may be used regardless of any polymerization degree thereof. The polyvinyl pyrrolidone may be a substituted polyvinyl pyrrolidone, and a preferred polyvinyl pyrrolidone has a molecular weight of from 1,000 to 400,000. As for the other monomers capable of copolymerizing with vinyl pyrrolidone, there are vinyl monomers including, for example, a (metha) acrylic ester such as acrylic acid, methacrylic acid and the alkyl esters thereof, a vinyl alcohol, a vinyl imidazol, a (metha) acrylamide, a vinyl carbinol, a vinyl alkyl ether and the like. It is preferred that at least 20% by weight of the composition thereof (hereinafter a percentage by weight will be referred simply to as '%') is polyvinyl pyrrolidone. In the preferred examples of such polymers, their molecular weight each are from 5,000 to 400,000.

The gelatins may be treated in a liming or acidizing process, and they may also be an ossein gelatin, a pigskin gelatin, a hide gelatin or a denatured gelatin in which the above-mentioned gelatin is esterified, or phenylcarbamoylated.

In the above-mentioned binders, a gelatin amount to the total binder amount is preferably from 10% to 90% by weight and more preferably from 20% to 60% by weight, and the amount of polymers of the invention thereto is preferably from 5% to 90% by weight and more preferably from 10% to 80% by weight.

The above-mentioned binders may contain other high molecular substances, and the preferred binders comprise, for example, gelatin and a mixture of polyvinyl pyrrolidone of from 1,000 to 400,000 in molecular weight and one or more than two of other high molecular substances, or they comprise gelatin and a mixture of a vinyl pyrrolidone copolymer of from 5,000 to 400,000 in molecular weight and one or more than two of other high molecular substances. As for the other high molecular substances to be used therein, there may be given as the examples, polyvinyl alcohol, polyacrylamide, polymethacrylamide, polyvinyl butyral, polyethylene glycol, a polyethylene glycol ester, or a natural substance including, for example, a protein such as a cellulose derivative, and a polysaccharide such as starch and gum arabic. The contents thereof may be from 0 to 85% by weight and preferably from 0 to 70% by weight.

In addition, the above-mentioned vinyl pyrrolidone polymers may also be cross-linked polymers, and if this is the case, it is preferred to make them cross-link after they are coated on a support. This case includes the case where a cross-linking reaction has progressed in nature.

The amount of the binders used therein is normally from 0.005 g to 100 g per square meter of a support, and more preferably from 0.01 g to 40 g. The binders are to be used preferably in the amount of from 0.1 g to 10 g per mol of a dye-providing material monomer unit, and more preferably in the amount of from 0.25 g to 4 g.

Supports used for the heat-developable color photo-sensitive materials of the invention include, for example, synthetic plastic films such as polyethylene film, cellulose acetate film, polyethylene terephthalate film and polyvinyl chloride, and paper supports such as photographic base paper, printing paper, baryta paper and resin-coated paper.

To the heat-developable color photo-sensitive material of the invention, if necessary, various additives may be added other than each constituents described above. For example, development accelerators include alkali-releasing agents such as urea and guanidium trichloroacetate described in U.S. Pat. Nos. 3,220,840, 3,531,285, 4,012,260, 4,060,420, 4,088,496 and 4,207,392, Research Disclosure Nos. 15733, 15734 and 15776, Japanese Patent O.P.I. Publication Nos. 130745/1981 and 132332/1981; an inorganic acid described in Japanese Patent Examined Publication No. 12700/1970; non-aqueous polar solvent compounds having —CO—, —$SO_2$— and —SO— group described in U.S. Pat. No. 3,667,959; Meltformer described in U.S. Pat. No. 3,438,776; polyalkylene glycol described in U.S. Pat. No. 3,666,477 and Japanese Patent O.P.I. Publication No. 19525/1976. As for the color tone control agents, those compounds disclosed in Japanese Patent O.P.I. Publication Nos. 4928/1971, 6077/1971, 5019/1974, 5020/1974, 91215/1974, 107727/1974, 2524/1975, 67132/1975, 67641/1975, 114217/1975, 33722/1977, 99813/1977, 1020/1978, 55115/1978, 76020/1978, 125014/1978, 156523/1979, 156524/1979, 156525/1979, 156526/1979, 4060/1980, 4061/1980 and 32015/1980; West German Pat. Nos. 2140406, 2147063 and 2220618; U.S. Pat. Nos. 3,080,254, 3,847,612, 3,782,941, 3,994,732, 4,123,282 and 4,201,582 may be used. Examples thereof are phthalazinone, phthalimide, pyrazolone, quinazolinone, N-hydroxynaphthalimide, benzoxazine, naphthoxazinedione, 2,3-dihydro-phthalazinedione, 2,3-dihydro-1,3-oxazine-2,4-dione, oxypyridine, aminopyridine, hydroxyquinoline, aminoquinoline, isocarbostyryl, sulfonamide, 2H-1,3-benzothiazine-2,4-(3H)dione, benzotriazine, mercaptotriazole, dimercaptotetrazapentalene, phthalic acid, naphthalic acid, phthalamine acid, a mixture of one or more of the above compounds with imidazole compounds, a mixture of at least one of phthalic acid, naphthalic acid or an acid anhydride thereof with phthalazine compounds, and a combination of phthalazine with maleic acid, itaconic acid, quinolinic acid and gentisinic acid. Further, there may also be effectively used those development accelerators described in Japanese Patent O.P.I. Publication Nos. 189628/1983 and 1934601/1983, which include, for example, 3-amino-5-mercapto-1,2,4-triazole and 3-acylamino-5-mercapto-1,2,4-triazole.

Those useful for the antifoggants are described in Japanese Patent Examined Publication No. 11113/1972, Japanese Patent O.P.I. Publication Nos. 90118/1974, 10724/1974, 97613/1974, 101019/1975, 130720/1974, 123331/1975, 47419/1976, 57435/1976, 78227/1976, 104338/1976, 19825/1978, 20923/1978, 50725/1976, 3223/1976, 42529/1976, 81124/1976, 51821/1979 and 93149/1980, British Patent No. 1,455,271, U.S. Pat. Nos. 3,885,968, 3,700,457, 4,137,079 and 4,138,265, West German Patent No. 2,617,907. Examples of these antifoggants include, for example, mercuric salts, oxidizing agents such as N-halogenoacetamides, N-halogenosuccinimides, perchloric acid and the salts thereof, inorganic peroxides and peroxosulfate; acids and the salts thereof such as sulfinic acid, lithium laurate, rosin, diterpenic acid, thiosulfonic acid; sulfur-containing compounds such as mercapto compound-releasing compounds, thiouracil, disulfide, sulfur in the form of a simple substance, mercapto-1,2,4-triazole, thiazolinethione and polysulfide compounds; oxazoline; 1,2,4-triazole and phthalimide. Thiol compounds and more preferably thiophenol compounds described in Japanese Patent O.P.I. Publication No. 111636/1984 are also useful as the antifoggants.

For the stabilizers, printout inhibitors especially for use after a heat-developing process may be used in combination. Examples thereof are given in Japanese Patent O.P.I. Publication Nos. 45228/1973, 119624/1975, 120328/1975, 46020/1978, which typically include halogenated hydrocarbons such as tetrabromobutane, tribromoethanol, 2-bromo-2-tolylacetamide, 2-bromo-2-tolylsulfonylacetamide, 2-tribromomethylsulfonylbenzothiazole and 2,4-bis(tribromomethyl)-6-methyltriazine.

In particular, the heat-developable color photo-sensitive materials of the invention are preferably added with a variety of thermal solvents. Any substances capable of accelerating a heat-development and/or a heat-transfer can serve as a thermal solvent of the invention. They are preferably a solid, semi-solid or liquid substance capable of being dissolved or fused in a binder when it is heated up, and those include, as the preferable ones, a urea derivative such as dimethylurea, diethylurea and phenylurea; an amide derivative such as acetamide, and benzamide; a polyhydric alcohol such as 1,5-pentanediol, 1-6-pentanediol, 1-2-cyclohexanediol, pentaerythritol, and trimethylolethane; or a polyethylene glycol. More typical examples are given in Japanese Patent Application No. 104249/1983. These thermal solvents may be used independently or in combination.

As for the antifoggants, a hydroquinone derivative described in Japanese Patent Application No. 56506/1984, such as di-t-octyl hydroquinone, dodecanyl hydroquinone; and a combination of hydroquinone derivative and a benzotriazole derivative such as 4-sulfobenzotriazole and 5-carboxybenzotriazole described in Japanese Patent Application No. 66380/1984, are preferably used.

Sulfur-containing compounds described in Japanese Patent Examined Publication No. 5393/1971, and Japanese Patent O.P.I. Publication Nos. 54329/1975 and 77034/1975 may be used for post-processing.

Further, they may contain the precursors of isothiuronium type stabilizers described in U.S. Pat. Nos. 3,301,678, 3,506,444, 3,824,103 and 3,844,788 and the precursors of activator stabilizers described in U.S. Pat. Nos. 3,669,670, 4,012,260 and 4,060,420.

Water releasing agents such as cane sugar and $NH_4Fe(SO_4)_2.12H_2O$ may also be used, and further, heat-development may be carried out by supplying water as is described in Japanese Patent O.P.I. Publication No. 132332/1981.

To the heat-developable color photo-sensitive material of the invention, besides the constituents mentioned above, various additives and coating aids such as spectral sensitizing dyes, antihalation dyes, optical brightening agents, hardners, antistatic agents, plasticizers and spreading agents may be added if necessary.

It is preferred that the heat-developable color photo-sensitive materials of the invention is to contain in the same layer (1) a photo-sensitive silver halide, (2) a reducing agent, (3) a dye-providing polymer which is a magenta dye-providing substance of the invention, (4) a binder, and, if required, (5) an organic silver salt. It is, however, not always needed to contain them into a single photographic component layer. For example, it is allowed that a photo-sensitive layer is divided into two layers and the components of the above-mentioned (1), (2), (4) and (5) are contained in one photo-sensitive layer, and the dye-providing polymer (3) which is the magenta dye-providing substance of the invention is contained in the other layer which is provided adjacently to the one layer, provided that the reactions can be made with each other.

Further, the same photo-sensitive layer may be separated into more than two layers, namely, a high-sensitive layer and a low-sensitive layer, and the like. The layer may be provided with two or more of the other photo-sensitive layers which differ in color sensitivity. The layer may be provided with various photographic component layers such as an over layer, a subbing layer, a backing layer, an intermediate layer, or a filter layer.

A heat-developable color photo-sensitive material of the invention, as one of the embodiments thereof, comprises a support bearing thereon at least a layer or a group of the layers containing a red-photo-sensitive silver halide, a reducing agent, a cyan-dye providing substance and a binder; a layer or a group of the layers containing a green-photo-sensitive silver halide, a reducing agent, a dye providing polymer of the invention and a binder; and a layer or a group of the layers containing a blue-photo-sensitive silver halide, a reducing agent, a yellow-dye-providing substance and a binder.

As described above, the dye-providing polymers which are the magenta dye-providing substances of the invention can be contained in the green photo-sensitive layer. The invention shall not be limited thereto, but the dye-providing polymers can be contained in other blue photo-sensitive layer or red photo-sensitive layer.

In the same manner used for the preparation of heat-developable photo-sensitive materials of the invention, a coating solution is prepared each for a protective layer, an interlayer, a subbing layer, a backing layer and other photographic component layers and coated by such various coating methods as a dipping method, an air knife method, a curtain coating method, and a hopper coating method described in U.S. Pat. No.

3,681,294, thus the photo-sensitive materials are prepared.

If necessary, by the methods described in U.S. Pat. No. 2,761,791 and British Patent No. 837,095, two or more layers can be simultaneously coated.

The constituents used for the photographic component layers of the heat-developable color photo-sensitive materials of the invention are coated on the support and the coating thickness after drying is preferably from 1 to 1,000 μm and more preferably from 3 to 20 μm.

The heat-developable color photo-sensitive material of the invention is color developed by being heated after imagewise exposure usually at from 80° C. to 200° C. and preferably at from 120° C. to 170° C. for from 1 sec. to 180 sec. and preferably from 1.5 sec. to 120 sec. And if necessary, it may be developed by contacting a water-impermeable material or it may be preheated at from 70° C. to 180° C. before exposure.

Various exposure means may be used for the heat-developable color photo-sensitive material of the invention. Latent images are obtained by imagewise exposure of rays of radiant light including visible radiation. Generally, light souces for ordinary color printing such as tungsten lamp, mercury lamp, xenon lamp, laser beam and CRT beam may be used as the light source thereof.

Heating methods applicable to ordinary heat-developable photo-sensitive materials may all be utilized, for example, bringing the materials into contact with a preheated block or plate, a heated roller or a heated drum, making the materials passing through high temperature atmosphere, using high-frequency heating, or providing a conductive layer in the photo-sensitive materials of the invention or in a thermal transfer image receiving layer (element) to utilize Joul's heat generated by applying electric current or a ferromagnetic field. Heating patterns have no particular limit, namely, it is allowed that the materials are preheated in advance and then heated again, that the materials are continuously heated by heating repeatedly for a short time at a high temperatre and then for a long time at a low temperature, and that the materials are heated discontinuously, however, an easy heating pattern is most preferable. And it is also preferable that the exposure and the heating process are made simultaneously.

In the invention, as for the image-pattern receiving layers capable of receiving the diffusive dyes produced imagewise by that a photographic component layer is exposed imagewise and heat-developed, those normally used in the field may be used. For example, a sheet of paper, cloth or plastic may be used, and preferably, those provided with an image receiving layer containing a compound having the capability of receiving a mordant or a dye onto a support may be used. The particularly preferred image receiving layers include, for example, the layers comprising polyvinyl chloride described in Japanese Patent Application No. 97907/1983, and the layers comprising polycarbonate and a plasticizer described in Japanese Patent Application No. 128600/1983.

The image receiving layers are allowed to be provided onto the one and the same support on which the above-mentioned photographic coponent layer is also provided. In this case, the image receiving layer may be so arranged as to be peeled off from the photographic component layer after the dyes were transferred, or the image receiving layer and the photographic component layer may be provided onto the separate supports, respectively. The formation of the image receiving layer shall not be limited particularly, but any technique can be used for the formation thereof.

(EXAMPLES OF THE INVENTION)

The examples of the invention will be described below, and it is, however, to be understood that the invention and the embodiments thereof shall not be limited thereto.

EXAMPLE 1

Dissolution of 470 mg of the exemplified dye-providing polymer (PM-1 of which the weight-average molecular weight $\overline{Mw}$ was 7,200) was made in 2.1 cc of ethyl acetate. The resulting solution was mixed in an aqueous solution of 2.5% gelatin containing a surface active agent, and was added with water to make 6.5 cc. After then, the resulting solution was dispersed by a homogenizer. Thus, a dye-providing polymer dispersion solution was obtained.

The dispersion solution obtained in the amount of 6.5 cc. was mixed with 3.5 cc of water containing 450 mg of polyvinyl pyrrolidone having the average molecular weight of 30,000 and 500 mg of 1,5-pentanediol, and was added with 200 mg of the above-mentioned reducing agent (R-3), and then, the pH value thereof was adjasted to 5.5 by making use of 3% citric acid. The resulting dispersion solution was added with a silver iodobromide emulsion (containing 85 mg of gelatin) of 0.1 μm in average particle size in the amount of $1\times10^{-3}$ mol in terms of silver, and was prepared by adding water to make 15 ml. Then the resulting emulsion was coated on a polyethyleneterephthalate support by a wire-bar so that the coated thickness can be 8 μm after dried. Thus, a photo-sensitive layer was prepared.

The resulting photo-sensitive material was dried and then exposed to white light of 16,000 CMS through a step-wedge.

Next, separately from the above, the image receiving surface of an image receiving sheet comprising a sheet of baryta paper coated thereon polyvinyl chloride as the material of the image receiving layer and the coated surface of the above-mentioned exposed photo-sensitive material are superposed one over the other, and a heat-development was carried out at 150° C. for one minute. After then the image receiving sheet was peeled off. Thus, a magenta transfer image was obtained on the image receiving sheet. Table 1 shows a maximum reflection density (Dmax) of the obtained transfer image and the fog (Dmin).

COMPARATIVE EXAMPLE 1

A photo-sensitive material similar to that of Example 1 was prepared, except that the dye-providing polymer, PM-1, in the photo-sensitive material of Example 1 was replaced by the following comparative polymer A, and the resulting photo-sensitive material was heat-developed similarly to the case of Example 1. The results thereof are shown in Table 1.

Comparative Polymer A

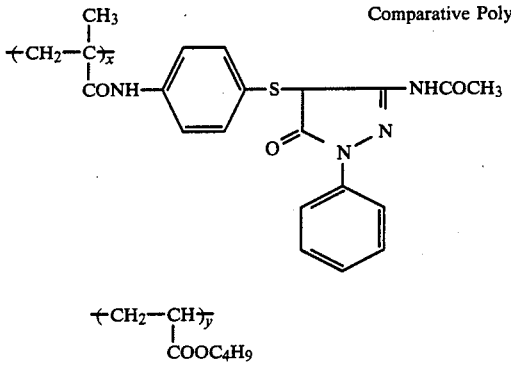

(x = 60% by weight)
(y = 40% by weight)
($M\overline{w}$ = 5,400)

TABLE 1

| | Dye-providing polymer | | Reducing | | |
|---|---|---|---|---|---|
| | Exemplification No. | Amount Added | Agent | Dmax | Dmin |
| Example 1 | PM-1 | 470 mg | R-3 | 0.67 | 0.07 |
| Comparative Example 1 | Comparative Polymer A | 340 mg | R-3 | 0.34 | 0.15 |

As is obvious from Table 1, it is found in the heat-developable color photo-sensitive material not using therein any organic silver salt that the Dmax is greater and Dmin is less in the samples using therein the dye-providing polymers of the invention than in the comparative sample.

EXAMPLE 2

[Preparation of 4-sulfobenzotriazole silver]

Dissolution of 24 g of 4-sulfobenzotriazole and 4 g of sodium hydroxide was made by adding 300 ml of a mixture of ethanol and water (The proportion thereof was 1:1). Into the resulting solution, 20 ml of 5-normal solution of silver nitrate were dropped and at this time 5-normal solution of sodium hydroxide was simultaneously dropped so as to keep the pH value at 7 to 8. The resulting solution was stirred at room temperature for one hour and was then prepared with 400 ml of water to prepare a solution of 4-sulfobenzotriazole silver containing 4-sulfobenzotriazole in an excessive amount by 20%.

[Preparation of photo-sensitive Material]

Dissolution of 470 mg of the dye-providing polymer (PM-1) which was similar to that used in Example 1 and 30 mg of 1,4-dioctylhydroquinone was made in 2.1 cc of ethyl acetate. The resulting solution was mixed in 3 cc of an aqueous solution of 2.5% gelatin containing a surface active agent and was added with water to make 6.5 ml. After then, the resulting solution was dispersed by making use of a homogenizer. Thus, a dispersion solution of the dye-providing polymer was obtained. The mixture of 4 ml of the above-mentioned solution of 4-sulfobenzotriazole silver was made with 6 cc of the dispersion solution of the dye-providing polymer, and the resulting mixture was further added with 450 ml of polyvinyl pyrolidone having an average molecular weight of 30,000, 120 mg of pentaerythritol, 420 mg of 1,5-pentanediol and 200 mg of the reducing agent (R-3) which was similar to that used in Example 1, and then the pH value thereof was adjusted to 5.5 with 3% citric acid. The resulting dispersion solution was added with a silver iodobromide emulsion (containing 75 mg of gelatin) having an average particle size of 0.05 μm in the amount of $3\times10^{-4}$ in terms of silver so as to make 14 ml with water, and then the resulting emulsion was coated over to a polyethyleneterephthalate support by making use of a wire-bar so that the dried thickness of the coat can be 8 μm. Thus, a photo-sensitive layer was provided.

After the resulting photo-sensitive material was dried up and exposed to a white light of 32,000 CMS through a step-wedge, a heat-development was applied under the similar conditions to an image receiving sheet similar to that used in Example 1, and a magenta transfer image was obtained on the image receiving sheet. Table 2 shows a maximum reflection density (Dmax) of the transfer image obtained and a fog (Dmin) of the photo-sensitive material.

EXAMPLE 3

A photo-sensitive material similar to that prepared in Example 2 was prepared, except that the dye-providing polymer PM-1 used in the photo-sensitive material of Example 2 was replaced by the dye-providing polymer shown in Table 2. The prepared photo-sensitive material was heat-developed similarly to the case of Example 2, and a magenta transfer image was obtained on an image receiving sheet. The results of the transfer image density obtained are also shown in Table 2.

EXAMPLE 4

A photo-sensitive material similar to that prepared in Example 2 was prepared, except that the reducing agent used in the photo-sensitive material prepared in Example 2 was replaced by the reducing agent shown in Table 2. The resulting photo-sensitive material was exposed and heat-developed similarly to the case of Example 2, and a magenta transfer image was obtained. The results of the transfer image density obtained are shown also in Table 2.

COMPARATIVE EXAMPLE 2

A photo-sensitive material similar to that prepared in Example 2 was prepared, except that the dye-providing polymer PM-1 used in the photo-sensitive material of Example 2 was replaced by the aforementioned comparative polymer A and the undermentioned comparative polymer B. The resulting photo-sensitive material was heat-developed similarly to the case of Example 2, and a magenta transfer image was obtained on the image receiving sheet.

Comparative Polymer B

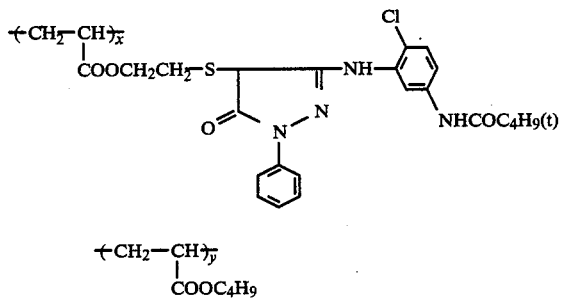

-continued (x = 33% by weight)
(y = 67% by weight)
($M\bar{w}$ = 4,900)

TABLE 2

| | Dye-providing polymer | | | | |
|---|---|---|---|---|---|
| | Exemplification No. | Amount Added (mg) | Reducing Agent | Dmax | Dmin |
| Example 2 | PM-1 | 470 | R-3 | 1.77 | 0.12 |
| Example 3 | PM-4 ($M\bar{w}$ = 6,900) | 690 | R-3 | 1.86 | 0.14 |
| Example 3 | PM-5 ($M\bar{w}$ = 5,800) | 420 | R-3 | 1.55 | 0.11 |
| Example 3 | PM-9 ($M\bar{w}$ = 15,900) | 860 | R-3 | 1.82 | 0.13 |
| Example 4 | PM-1 | 470 | R-1 | 1.71 | 0.15 |
| Example 4 | PM-1 | 470 | R-9 | 1.62 | 0.10 |
| Comparative Example 2 | Comparative Polymer A | 340 | R-3 | 2.05 | 0.65 |
| Comparative Example 2 | Comparative Polymer B | 780 | R-3 | 1.40 | 0.55 |

As is obvious from Table 2, in the heat-developable color photo-sensitive materials of the invention, the maximum reflection density thereof is stable at a greater value than in the comparative examples, and a magenta transfer image being further improved in foginess can be obtained.

EXAMPLE 5

The primary photo-sensitive layer was provided by coating on a polyethyleneterephthalate support in the same manner as in Example 2, except that silver iodobromide having an average particle size of 0.05 μm which was used in the photo-sensitive layer of Example 2 was replaced by green light-sensitive silver iodobromide having an average particle size of 0.125 μm and the dried thickness of 8 μm was changed to 6 μm.

In succession, 400 mg of the undermentioned polymer 1 (a scavenger of a color developer oxidized product) were dissolved in 1.2 cc of ethyl acetate, and the resulting solution was mixed with 3 cc of an aqueous solution of 2.5% of gelatin containing a surface active agent, and water was added therein to make 6 cc. After then, the resulting solution was dispersed by making use of a homogenizer. Thus, the dispersion solution of a dye-providing polymer was obtained. The resulting dispersion solution was mixed with 450 mg of polyvinyl pyrolidone having an average molecular weight of 30,000, 120 mg of polyethylene glycol having a molecular weight of 300 and 6 cc of an aqueous solution containing 420 mg of 3-methyl-1,3,5-pentanetriol and 75 mg of gelatin, and the resulting mixture was added with water to make 15 cc. Thus, an interlayer was provided by coating the resulting solution on the primary photo-sensitive layer by making use of a wire-bar, so that the dried thickness can be 2 μm.

(A scavenger of a color developer oxidized product) Polymer 1

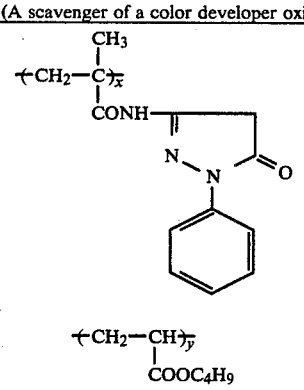

(x = 50% by weight)
(y = 50% by weight)

Next, the secondary photo-sensitive layer was provided by coating the same layer as was used in the primary layer, except that the silver halide emulsion used in the primary photo-sensitive layer was replaced by a red-sensitive silver iodobromide emulsion of 0.125 μm in an average particle size in the amount added of $1\times10^{-3}$ mol in terms of silver, and the dye-providing polymers were also replaced by the following compound 1 used in the amount of 830 mg.

Compound 1

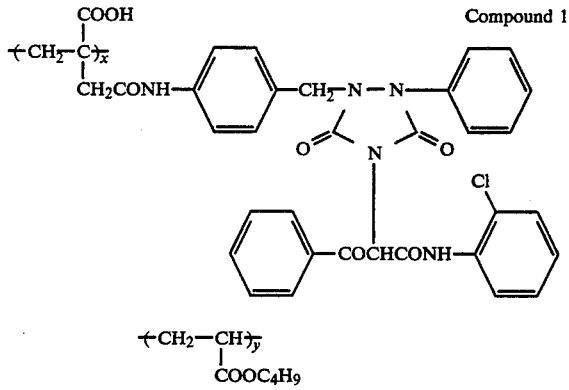

(x = 40% by weight)
(y = 60% by weight)

As described above, the multilayered photo-sensitive material comprising a support bearing the primary photo-sensitive layer, the interlayer and the secondary photo-sensitive layer was exposed to red-light of 1,600 CMS through a step wedge and was heat-developed similarly to the case of Example 2. After then the image receiving sheet was peeled off. The density (Dmax and Dmin) of the resulting dye image was measured by making use of a green light and a blue light, respectively. The results thereof are shown in Table 3.

COMPARATIVE EXAMPLE 3

A photo-sensitive material similar to that prepared in Example 5 was prepared, except that the dye-providing polymer PM-1 in the amount added of 470 mg for the primary photo-sensitive layer used in the photo-sensitive material prepared in Example 5 was replaced by the following Compound 2 in the amount added of 300 mg. Thus prepared photo-sensitive material was exposed and heat-developed in the same process as in Example 4.

The results of the image density obtained are shown in Table 3.

Compound 2

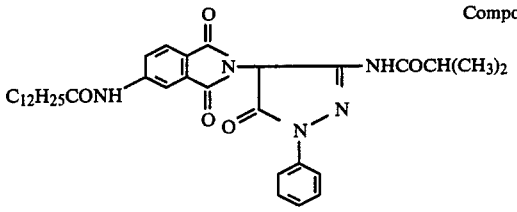

TABLE 3

| | Measurement through a green light | | Measurement through a blue light | |
|---|---|---|---|---|
| | Dmax | Dmin | Dmax | Dmin |
| Example 5 | 0.18 | 0.13 | 1.97 | 0.09 |
| Comparative Example 3 | 1.34 | 0.35 | 1.45 | 0.08 |

As is obvious from the results shown in Table 3, in the photo-sensitive materials multilayered by making use of the dye-providing polymers of the invention, it is found that the dye-providing substances are presumably immobilized rather than in the comparative examples so that such excellent characteristics can be displayed that no color turbidity occurs during a heat-development process even if a dye-providing substance might migrate into other layer to form a dye.

What is claimed is:

1. In a heat-developable color photo-sensitive material comprising a support bearing thereon a photographic component layer containing at least a photosensitive silver halide, a reducing agent, a binder and a dye-providing material; said heat-developable photosensitive material characterized in that at least one of said dye-providing materials is a polymer having a repetition unit being derived from a monomer represented by the Formula below:

Formula [I]

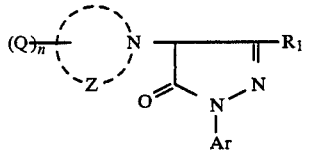

wherein, Q represents an ethylene unsaturated group or a group having an ethylene unsaturated group; Z represents a group of atoms required for forming a nitrogen-containing heterocyclic residual group in which a polymerizable ethylene unsaturated bond may also be incorporated into the heterocyclic ring, together with a nitrogen atom; $R_1$ represents an alkyl, aryl, alkylamino, anilino, acylamino or ureido group; Ar represents an aryl group or a heterocyclic residual group; and n is an integer of zero or one with the proviso that, when n is equal to zero, Z has an ethylene unsaturated bond in the ring of the heterocyclic residual group.

2. The heat-developable color photo-sensitive material as claimed in claim 1, wherein the molecular weight of said polymer is from 1,500 to 100,000 in weight average molecular weight.

3. The heat-developable color photo-sensitive material as claimed in claim 1, wherein said photo-sensitive material contains said polymer in an amount of from 0.005 to 10 g per sq. meter of said photo-sensitive material.

4. The heat-developable color photo-sensitive material as claimed in claim 1, wherein said photo-sensitive component layer contains said photo-sensitive siver halide in an amount of from 0.02 to 10 mol per mol of the monomer unit represented by the Formula.

5. The heat-developable color photo-sensitive material as claimed in claim 1, wherein said reducing agent is represented by the following Formula:

Formula [III]

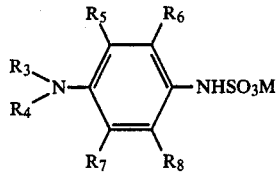

wherein, $R_3$ and $R_4$ each represent hydrogen or an alkyl group which is allowed to have a substituent and has one to 30 carbon atoms, and the $R_3$ and $R_4$ may close a ring so as to form a heterocyclic ring; $R_5$, $R_6$, $R_7$ and $R_8$ each represent hydrogen, a halogen, a hydroxy group, an amino group, an alkoxy group, an acylamide group, a sulfonamide group, an alkylsulfonamide group, or an alkyl group which is allowed to have a substituent and has one to 30 carbon atoms, and the $R_5$ and $R_3$, and the $R_7$ and $R_4$ each may close the ring so as to form a heterocyclic ring, respectively; and M represents an alkaline metal atom, an ammonium group, or a compound residual group containing a nitrogen-containing organic base or a quaternary nitrogen atom.

6. The heat-developable color photo-sensitive material as claimed in claim 1, wherein said photographic component layer contains said reducing agent in an amount of from 0.05 to 10 mol per mol of the monomer unit represented by the Formula.

7. The heat-developable color photo-sensitive material as claimed in claim 1, wherein said binder is a mixture of gelatin or the derivatives thereof and other hydrophilic polymer.

8. The heat-developable color photo-sensitive material as claimed in claim 1, wherein said binder contains gelatin and a vinylpyrolidone polymer.

9. The heat-developable color photo-sensitive material as claimed in claim 7, wherein the gelatin contained in said binder is in the proportion of from 10 to 90% by weight of the binder.

10. The heat-developable color photo-sensitive material as claimed in claim 1, wherein said binder is in an amount of from 0.1 to 10 g per mol of the monomer unit represented by the Formula.

11. The heat-developable color photo-sensitive material as claimed in claim 5, wherein $R_3$ and $R_4$ each represent an alkyl group having one to four carbon atoms.

12. The heat-developable color photo-sensitive material as claimed in claim 5, wherein $R_5$, $R_6$, $R_7$ and $R_8$ each represent an alkyl group having one to four carbon atoms.

13. The heat-developable color photo-sensitive material as claimed in claim 11, wherein $R_5$, $R_6$, $R_7$ and $R_8$ each represent an alkyl group having one to four carbon atoms.

* * * * *